US010647124B2

(12) United States Patent
Horade

(10) Patent No.: US 10,647,124 B2
(45) Date of Patent: May 12, 2020

(54) INKJET RECORDING APPARATUS CAPABLE OF INITIALIZING COUNT VALUE INDICATIVE OF INK QUANTITY IN INK CHAMBER BASED ON INK EJECTION QUANTITY

(71) Applicant: BROTHER KOGYO KABUSHIKI KAISHA, Nagoya-shi, Aichi-ken (JP)

(72) Inventor: Kenta Horade, Tokai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 117 days.

(21) Appl. No.: 15/904,672

(22) Filed: Feb. 26, 2018

(65) Prior Publication Data

US 2018/0244066 A1 Aug. 30, 2018

(30) Foreign Application Priority Data

Feb. 27, 2017 (JP) ..... 2017-034883

(51) Int. Cl.
*B41J 2/175* (2006.01)
*B41J 29/13* (2006.01)
*B41J 29/38* (2006.01)

(52) U.S. Cl.
CPC ..... *B41J 2/17509* (2013.01); *B41J 2/1752* (2013.01); *B41J 2/17503* (2013.01);
(Continued)

(58) Field of Classification Search
CPC ..... B41J 2/17509; B41J 2/17503; B41J 2/17566; B41J 2002/17589; B41J 2/17513;
(Continued)

(56) References Cited

U.S. PATENT DOCUMENTS

2002/0024543 A1* 2/2002 Kimura ..... B41J 2/17509 347/7
2013/0257972 A1 10/2013 Kubo et al.
(Continued)

FOREIGN PATENT DOCUMENTS

JP 2016-132217 A 7/2016
JP 2016-132221 A 7/2016

OTHER PUBLICATIONS

Office Action issued in related U.S. Appl. No. 15/904,663, dated Aug. 15, 2019.

(Continued)

*Primary Examiner* — Justin Seo
(74) *Attorney, Agent, or Firm* — Merchant & Gould P.C.

(57) ABSTRACT

An inkjet recording apparatus includes: a tank having ink chamber; a recording head; a memory storing a count value updated toward a first threshold value in accordance with ejection of ink; a display; an operation interface; a power switching section switched between a first state and a second state; and a controller executes a first inquiry process to: display a first inquiry screen inquiring whether the ink chamber has been refilled with ink; and receive one of a first operation and a second operation. After receiving the first operation, the controller determines when ink has been supplied. In response to determining that ink has been supplied just before the first inquiry process, the controller sets the count value to a first initial value. In response to determining that ink has been supplied during the second state, the controller sets the count value to a second initial value.

14 Claims, 15 Drawing Sheets

(52) U.S. Cl.
CPC ..... *B41J 2/17513* (2013.01); *B41J 2/17553* (2013.01); *B41J 2/17566* (2013.01); *B41J 29/13* (2013.01); *B41J 29/38* (2013.01); *B41J 2002/17589* (2013.01)

(58) Field of Classification Search
CPC ..... B41J 2/1752; B41J 2/17553; B41J 29/13; B41J 29/38
See application file for complete search history.

(56) References Cited

U.S. PATENT DOCUMENTS

| | | | |
|---|---|---|---|
| 2016/0207339 | A1 | 7/2016 | Honoki |
| 2016/0214392 | A1 | 7/2016 | Honoki et al. |
| 2017/0057240 | A1 | 3/2017 | Munakata |

OTHER PUBLICATIONS

Final Office Action issued in related U.S. Appl. No. 15/904,663, dated Mar. 23, 2020.

* cited by examiner

INKJET RECORDING APPARATUS CAPABLE OF INITIALIZING COUNT VALUE INDICATIVE OF INK QUANTITY IN INK CHAMBER BASED ON INK EJECTION QUANTITY

CROSS REFERENCE TO RELATED APPLICATION

This application claims priority from Japanese Patent Application No. 2017-034883 filed Feb. 27, 2017. The entire content of the priority application is incorporated herein by reference.

TECHNICAL FIELD

The present disclosure relates to an inkjet recording apparatus configured to record an image on a sheet.

BACKGROUND

Japanese Patent Application Publication No. 2016-132221 discloses one example of an inkjet recording apparatus with refillable ink tanks. A user injects ink from an ink bottle into an ink chamber through an inlet opening formed in the ink tank. The inkjet recording apparatus is provided with a cover for covering the inlet opening for the ink chamber. When the inkjet recording apparatus detects using a cover sensor that the cover was opened and then closed (hereinafter simply describe as "when the cover is opened and closed"), the inkjet recording apparatus prompts the user to indicate whether the ink chamber has been refilled with ink. In response to the user operation to indicate that the ink chamber has been refilled with ink, the conventional inkjet recording apparatus initializes a count value indicative of a residual ink quantity.

SUMMARY

However, the inkjet recording apparatus disclosed in Japanese Patent Application Publication No. 2016-132221 cannot detect that the cover is opened and closed while electric power is not supplied to the cover sensor, and hence, cannot confirm with the user whether the ink chamber was refilled in such cases. That is, the inkjet recording apparatus cannot initialize the count value if the user injects ink into the ink chamber while the inkjet recording apparatus is in a power OFF state. This causes a deviation between the residual ink quantity indicated by the count value and an actual quantity of ink stored in the ink chamber in a case where the ink chamber is refilled with ink while the inkjet recording apparatus is in the power OFF state. This problem may occur not only when the inkjet recording apparatus initializes the count value when the cover is opened and closed, but may also occur when the inkjet recording apparatus initializes the count value by means of other methods.

In view of the foregoing, it is an object of the present disclosure to provide an inkjet recording apparatus capable of suppressing deviation between a residual quantity of ink indicated by a count value and an actual quantity of ink stored in an ink chamber.

In order to attain the above and other objects, according to one aspect, the disclosure provides an inkjet recording apparatus including: a tank; a recording head; a memory; a display; an operation interface; a power switching section; and a controller. The tank has an ink chamber configured to store ink therein and formed with an inlet through which the ink is supplied into the ink chamber. The recording head is configured to eject the ink stored in the ink chamber toward a sheet to record an image thereon. The memory stores a first threshold value and a count value. The count value is indicative of an accumulated count value and is updated toward the first threshold value in accordance with ejection of ink. The operation interface is configured to receive a user operation including a first operation and a second operation. The power switching section is configured to be switched between a first state and a second state. Under the first state, the power switching section supplies an electric power to both the recording head and the display, whereas under the second state, the power switching section interrupts supply of an electric power to both the recording head and the display. The controller is configured to: execute a first inquiry process to: control the display to display a first inquiry screen inquiring whether the ink chamber has been refilled with ink; and receive either one of the first operation and the second operation through the operation interface, wherein the first operation indicates that the ink chamber has been refilled with ink, whereas the second operation indicates that the ink chamber has not been refilled with ink; after receiving the first operation in the first inquiry process, execute a first determination process to determine when the ink chamber has been refilled with ink; in response to determining in the first determination process that the ink chamber has been refilled with ink at a time just before the first inquiry process, execute a first initialization process to set the count value to a first initial value, a difference between the count value and the first threshold value becoming maximum when the count value is set to the first initial value; and in response to determining in the first determination process that the ink chamber has been refilled with ink while the power switching section is in the second state, execute a second initialization process to set the count value to a second initial value, the second initial value being closer to the first threshold value than the first initial value is to the first threshold value by an ink ejection quantity, the ink ejection quantity being a quantity of ink ejected from the recording head since the power switching section was switched from the second state to the first state.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1A:
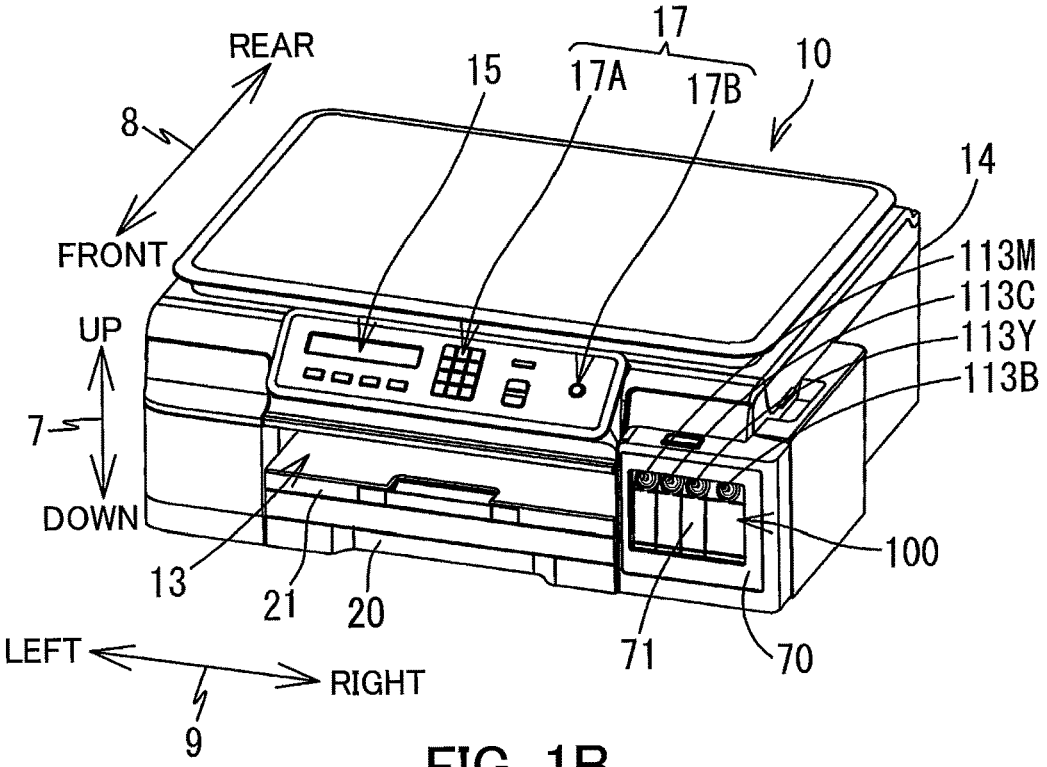
FIG. 1A is a perspective view of a multifunction peripheral (MFP) 10 according to one embodiment of the present disclosure, and illustrating a covering position of a cover 70 of the MFP 10.

Hereinafter, a multifunction peripheral (hereinafter abbreviated as "MFP") 10 according to one embodiment of the present disclosure will be described with reference to FIGS. 1 to 10. It would be apparent that the embodiment described below is merely an example of the disclosure and may be modified in many ways without departing from the scope of the disclosure.

In the following description, an up-down direction 7 is defined based on an orientation of the MFP 10 when the MFP 10 is ready to use (hereinafter referred to as an "operable posture"); a front-rear direction 8 is defined so that a side of the MFP 10 in which a discharge opening 13 is formed is a front side; and a left-right direction 9 is defined based on a perspective of an user facing the front side of the MFP 10.

<Overall Structure of MFP 10>

As illustrated in FIGS. 1A, 1B, 2, and 5, the MFP 10 includes a feed tray 20, a discharge tray 21, a conveying section 23, a recording section 24, and an ink tank 100. The ink tank 100 is an example of a tank. These components of the MFP 10 are accommodated in a casing 14 having a general rectangular parallelepiped shape. The MFP 10 has a printer function for recording images on sheets according to an inkjet recording method. The MFP 10 may also have other functions, such as a facsimile function and a scanning function. The MFP 10 is an example of an inkjet recording apparatus.

<Feed Tray 20 and Discharge Tray 21>

Figure 1B:
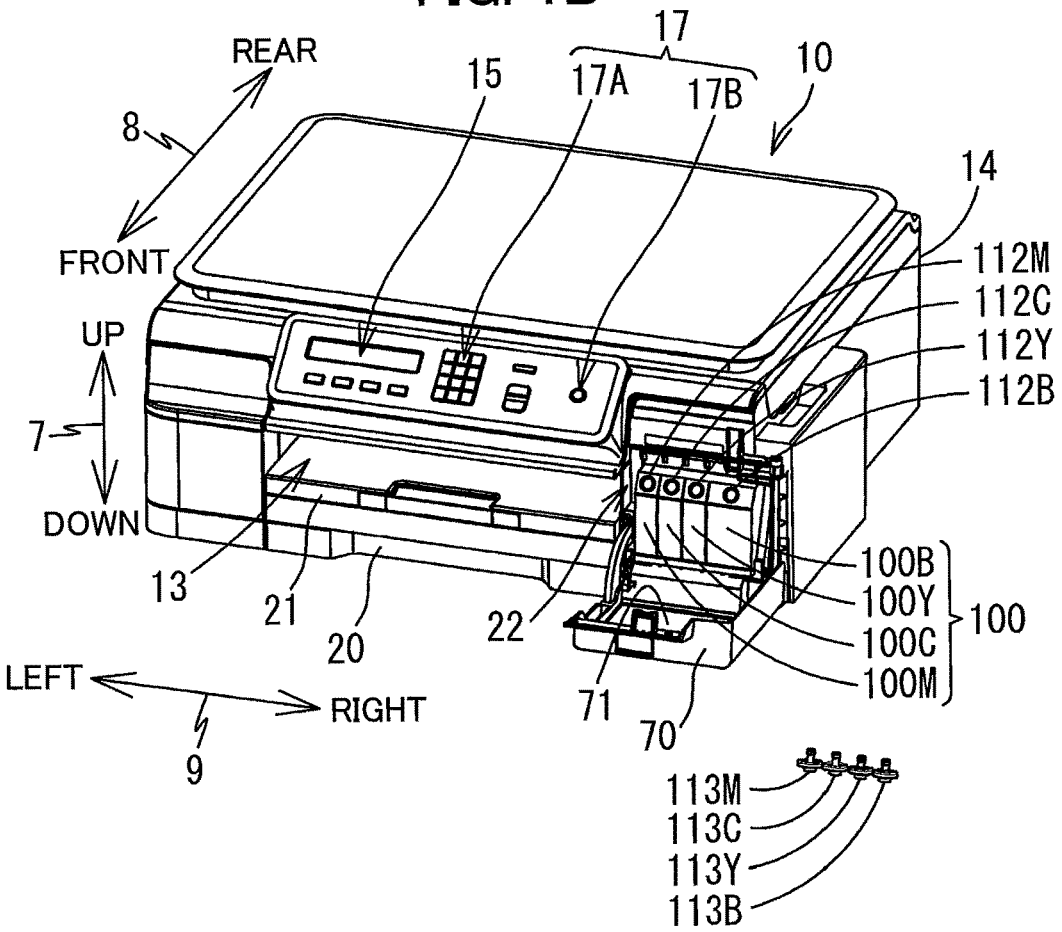
FIG. 1B is a perspective view of the MFP 10 according to the embodiment, and illustrating an exposing position of the cover 70.

As illustrated in FIGS. 1A and 1B, the discharge opening 13 is formed in a front surface of the casing 14 at its center region in the left-right direction 9. The feed tray 20 is inserted into and removed from the casing 14 through the discharge opening 13 in the front-rear direction 8. The feed tray 20 can support a plurality of sheets in a stacked state. The discharge tray 21 is disposed above the feed tray 20. The discharge tray 21 is inserted into and removed from the casing 14 together with the feed tray 20. The discharge tray 21 supports sheets discharged by the conveying section 23.

<Conveying Section 23 and Recording Section 24>

The conveying section 23 is configured to convey the sheets supported on the feed tray 20 along a conveying path that leads to the discharge tray 21 while passing through a position in which the sheets face the recording section 24. The conveying section 23 includes a plurality of rollers and the like that rotate while in contact with the sheets, for example. The recording section 24 is configured to record images on sheets conveyed by the conveying section 23 by ejecting ink stored in the ink tank 100. The recording section 24 includes a carriage that is movable in a main scanning direction crossing a direction in which the sheets are conveyed, and a recording head that is mounted on the carriage and configured to eject ink from nozzles, for example. The recording section 24 is an example of a recording head.

Figure 2:
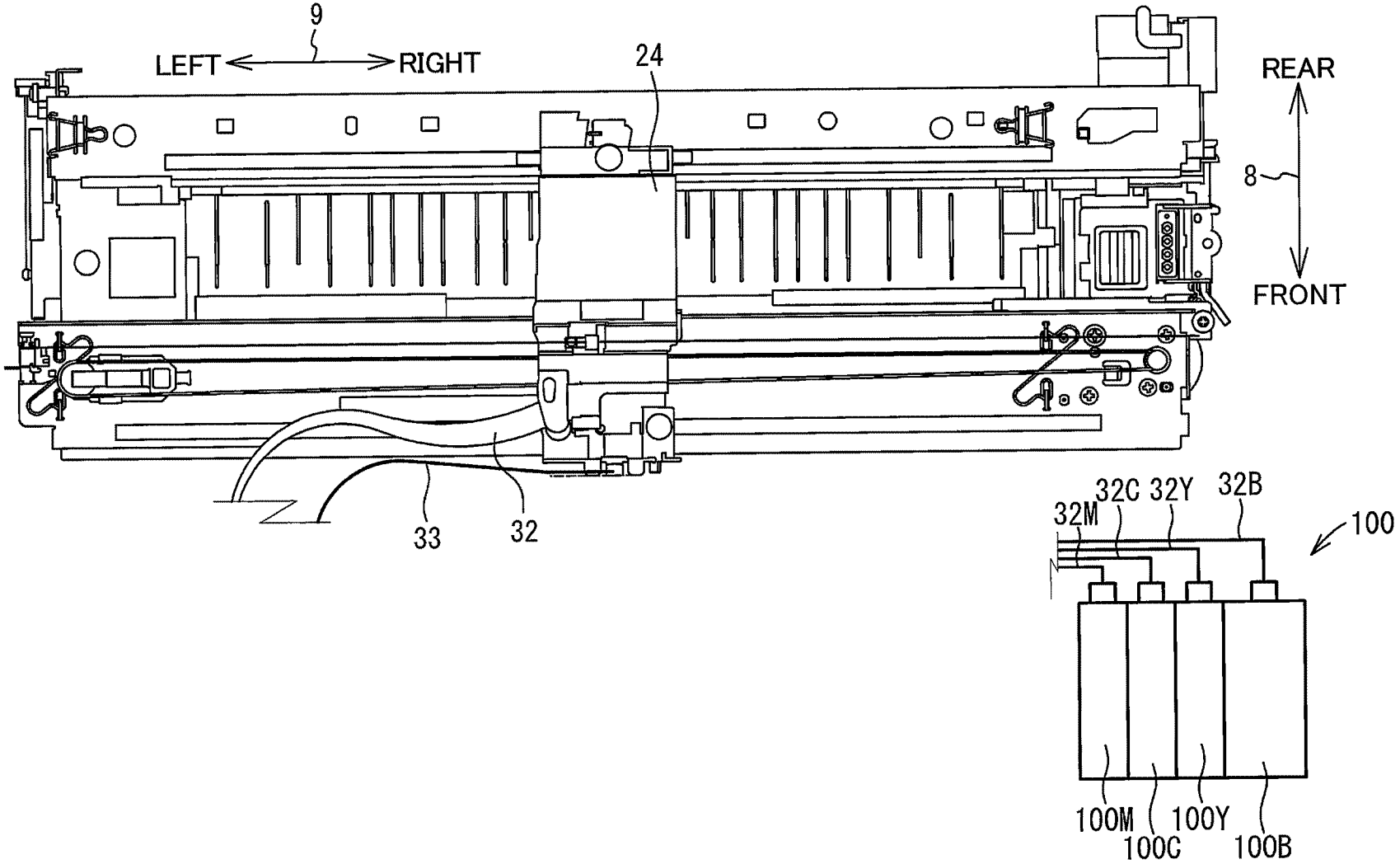
FIG. 2 is a plan view of a recording section 24 and an ink tank 100 in the MFP 10 according to the embodiment.

As illustrated in FIG. 2, ink tubes 32 and a flexible flat cable 33 are connected to the recording section 24. The ink tubes 32 are configured to supply ink stored in the ink tank 100 to the recording section 24. More specifically, the ink tubes 32 include four ink tubes 32B, 32Y, 32C, and 32M (hereinafter collectively referred to as the ink tubes 32) for allowing ink of four colors, i.e., black, magenta, cyan, and yellow, to flow therethrough, respectively. The ink tubes 32 are bundled together, with one end of the ink tubes 32 connected to and extending from the ink tank 100 and the other end connected to the recording section 24. The flexible flat cable 33 is configured to transmit control signals outputted from a controller 130 (see FIG. 5) to the recording section 24.

<Ink Tank 100>

As illustrated in FIGS. 1A and 1B, the ink tank 100 is installed in an interior space of the casing 14 at its right-front portion. That is, the ink tank 100 is fixed in the MFP 10 and cannot easily be removed from the casing 14. Here, the phrase "cannot easily be removed" is intended to mean that a general user cannot simply remove the ink tank 100 from the MFP 10 under normal operating conditions, for example. There is no need to install the ink tank 100 in such a way that makes them impossible to remove from the MFP 10.

The ink tank 100 is configured to store ink to be supplied to the recording section 24. As illustrated in FIG. 1B, the ink tank 100 includes four tanks 100B, 100Y, 100C, and 100M. Each of the tanks 100B, 100Y, 100C, and 100M stores ink of a different color. Specifically, the tank 100B stores black ink, the tank 100Y stores yellow ink, the tank 100C stores cyan ink, and the tank 100M stores magenta ink. However, the number of tanks 100B, 100Y, 100C, and 100M and the colors of ink stored therein are not limited to the above example.

The four tanks 100B, 100Y, 100C, and 100M are disposed in a row along the left-right direction 9. Of the four tanks 100B, 100Y, 100C, and 100M, the tank 100B is disposed farthest to the right while the tank 100M is disposed farthest to the left. The tank 100B has a width in the left-right direction 9 greater than those of the other tanks 100Y, 100C, and 100M. The tank 100B also has an ink chamber 111B (described later) with a capacity greater than those of ink chambers 111Y, 111C, and 111M of the other tanks 100Y, 100C, and 100M. However, arrangement of the tanks 100B, 100Y, 100C, and 100M, sizes of the tanks 100B, 100Y, 100C, and 100M, and capacities of the ink chambers 111 are not limited to the relationships described in the above example.

Figure 3:
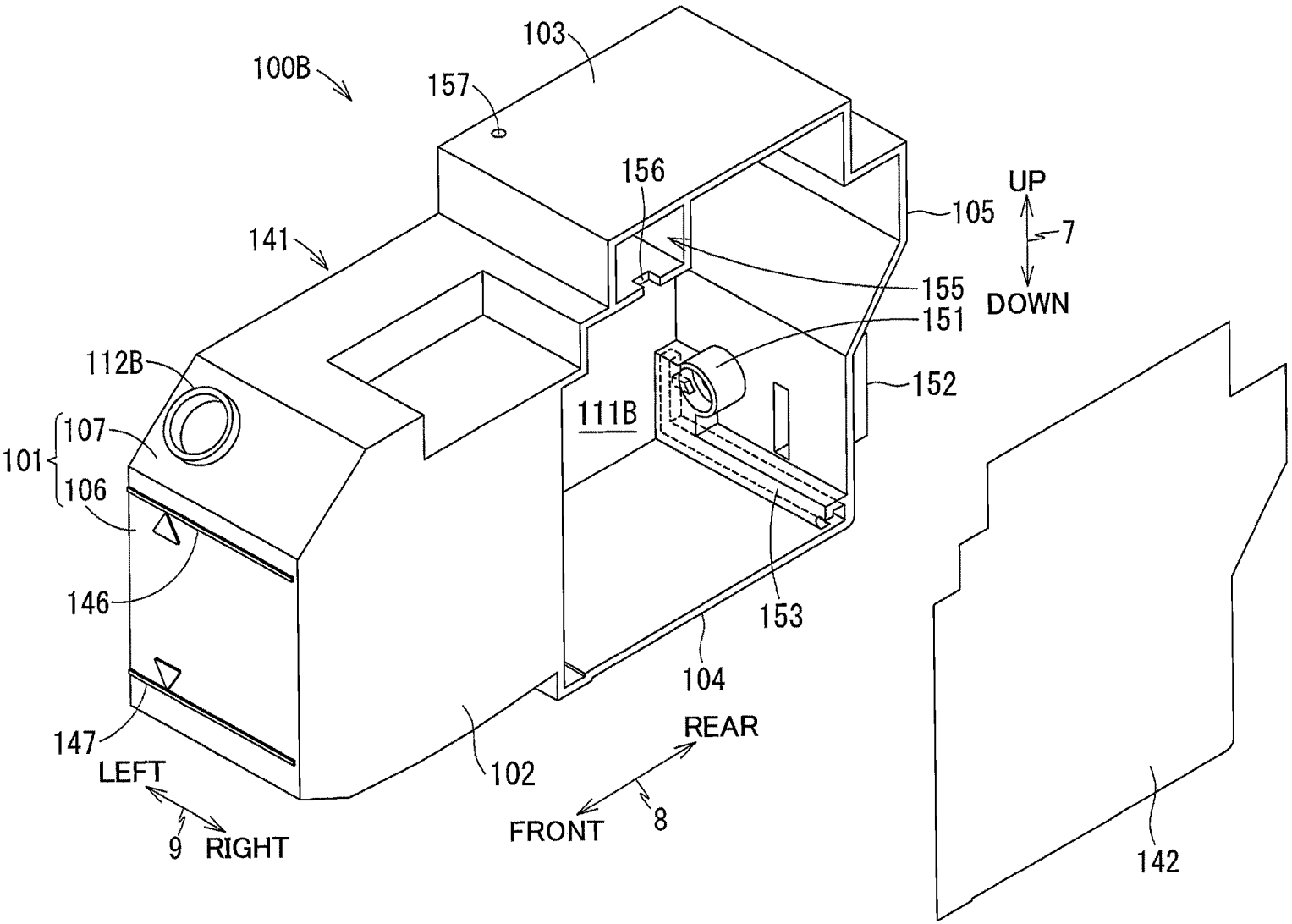
FIG. 3 is a perspective view of a tank 100B in the MFP 10 according to the embodiment as viewed from a front side thereof.
Figure 4:
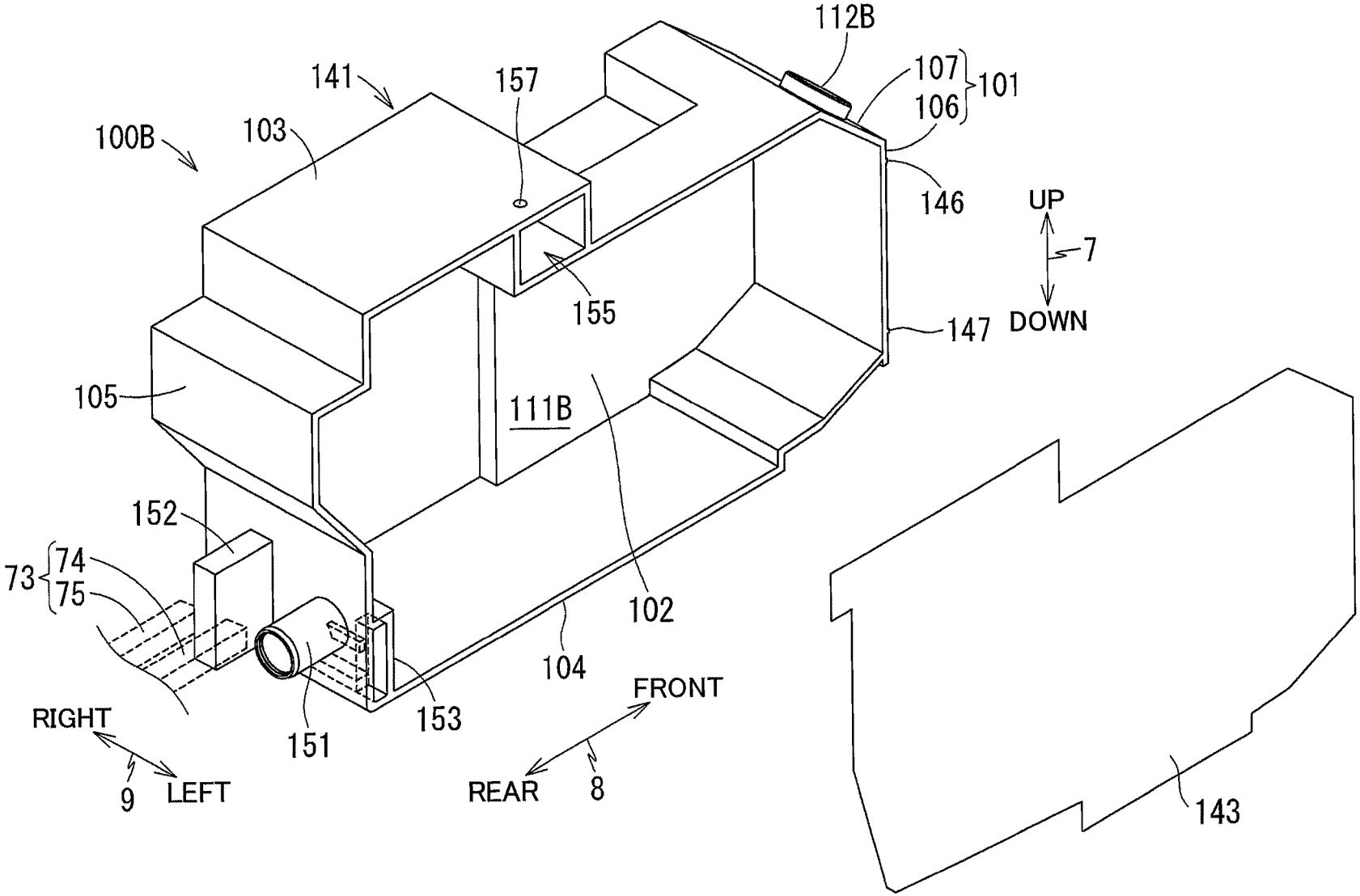
FIG. 4 is a perspective view of the tank 100B as viewed from a rear side thereof.

As illustrated in FIGS. 3 and 4, the tank 100B includes a frame 141, and two films 142 and 143. The frame 141 has a general rectangular parallelepiped shape that is flattened in the left-right direction 9 such that its dimensions in the up-down direction 7 and the front-rear direction 8 are greater than its dimension in the left-right direction 9. The frame 141 is formed of a resin (polypropylene, for example) that is sufficiently translucent to allow visual recognition of ink stored in the ink chamber 111B from outside the tank 100B. The frame 141 may be integrally molded through injection molding of a resin material, for example.

The frame 141 includes a front wall 101, a right wall 102, a top wall 103, a bottom wall 104, and a rear wall 105. A left end and part of a right end of the frame 141 are open. The films 142 and 143 are melt-bonded to the frame 141 so as to seal the openings in the left and right ends of the frame 141. An interior space of the tank 100B defined by the front wall 101, the right wall 102, the top wall 103, the bottom wall 104, the rear wall 105, and the films 142 and 143 constitutes the ink chamber 111B in which the ink is stored. Note that the ink chamber 111B may instead be defined by inner walls (not illustrated) positioned inside the outer walls 101-105 constituting the frame 141. Alternatively, the ink chamber 111B may be divided into a plurality of small regions by partitioning walls (not illustrated).

The front wall 101 is configured of a vertical wall 106, and a sloped wall 107. The vertical wall 106 expands in the up-down direction 7 and the left-right direction 9. The sloped wall 107 is connected between a top edge of the vertical wall 106 and a front edge of the top wall 103. The sloped wall 107 slopes relative to the up-down direction 7 and the front-rear direction 8. An inlet 112B is formed in the sloped wall 107. Ink is injected, or poured, into the ink chamber 111B through the inlet 112B. The inlet 112B penetrates the sloped wall 107 in a thickness direction thereof, allowing the ink chamber 111B to be in communication with an exterior of the tank 100B.

The inlet 112B is closed with a cap 113B. As illustrated in FIG. 1A, the cap 113B attached to the sloped wall 107 intimately contacts a surface of the sloped wall 107 defining a peripheral edge of the inlet 112B to seal the inlet 112B. As illustrated in FIG. 1B, on the other hand, the cap 113B is removed from the sloped wall 107 to open the inlet 112B. Here, the cap 113B can be attached to and removed from the sloped wall 107 while a cover 70 (described later) is in its exposing position. By removing the cap 113B from the inlet 112B, the user can inject ink into the ink chamber 111B through the inlet 112B.

As illustrated in FIGS. 3 and 4, a first line 146 and a second line 147 are provided on an outer surface of the vertical wall 106. The first line 146 and the second line 147 both extend in the left-right direction 9. When the MFP 10 is in its operable posture, the first line 146 is positioned approximately at a height in the up-down direction 7 the same as a level of ink in the ink chamber 111B when the ink chamber 111B stores ink of a preset maximum storage quantity. The maximum storage quantity corresponds to the quantity of ink stored in a single ink bottle (not illustrated), for example. When the MFP 10 is in its operable posture, the second line 147 is positioned lower in the up-down direction 7 than the first line 146 and higher in the up-down direction 7 than a detection position described later.

An ink supply portion 151 is provided at the rear wall 105. The ink supply portion 151 has a cylindrical shape with a hollow interior space. The ink supply portion 151 protrudes rearward from an outer surface of the rear wall 105. A distal end (i.e., protruding end) of the ink supply portion 151 is open. The interior space of the ink supply portion 151 is in communication with the ink chamber 111B through an ink channel 153 described later. By connecting the ink tube 32B to the ink supply portion 151 so that one end portion of the ink tube 32B covers an outer surface of the ink supply portion 151, ink stored in the ink chamber 111B is supplied to the ink tube 32B through the ink supply portion 151.

An ink detection portion 152 is provided at the rear wall 105. The ink detection portion 152 protrudes rearward from the outer surface of the rear wall 105. The ink detection portion 152 has a box shape with a hollow interior space. The ink detection portion 152 is formed of a light transmissive material that allows transmission of light irradiated from a light-emitting portion 74 described later. The interior space of the ink detection portion 152 is in communication with the ink chamber 111B. Hence, ink is present in the interior space of the ink detection portion 152 when the level of ink in the ink chamber 111B is higher than a lower edge of the ink detection portion 152. On the other hand, ink is not present in the interior space of the ink detection portion 152 when the level of ink in the ink chamber 111B is lower than the lower edge of the ink detection portion 152.

The ink channel 153 is a long narrow path for supplying ink stored in the ink chamber 111B to the ink supply portion 151. The ink channel 153 has one end that communicates with the ink chamber 111B at a position in contact with an inner surface of the bottom wall 104, and another end that communicates with the interior space of the ink supply portion 151. More specifically, the ink channel 153 extends leftward from its communicating position with the ink chamber 111B, and then extends upward at the left end of the tank 100B, and lastly extends rightward from a position of height equal to the ink supply portion 151 to communicate with the interior space of the ink supply portion 151.

An air communication portion 155 is also provided in the tank 100B. The air communication portion 155 is an air passage that allows the ink chamber 111B to communicate with external air. The air communication portion 155 is provided at a position upward relative to the inlet 112B in the up-down direction 7. The air communication portion 155 has one end that communicates with the ink chamber 111B through a notch 156 formed in a bottom wall of the air communication portion 155, and another end that communicates with an exterior of the tank 100B through a through-hole 157 penetrating the top wall 103. A labyrinth channel, a semipermeable membrane, or the like may be provided inside the air communication portion 155.

<Residual Ink Sensor 73>

Figure 5:
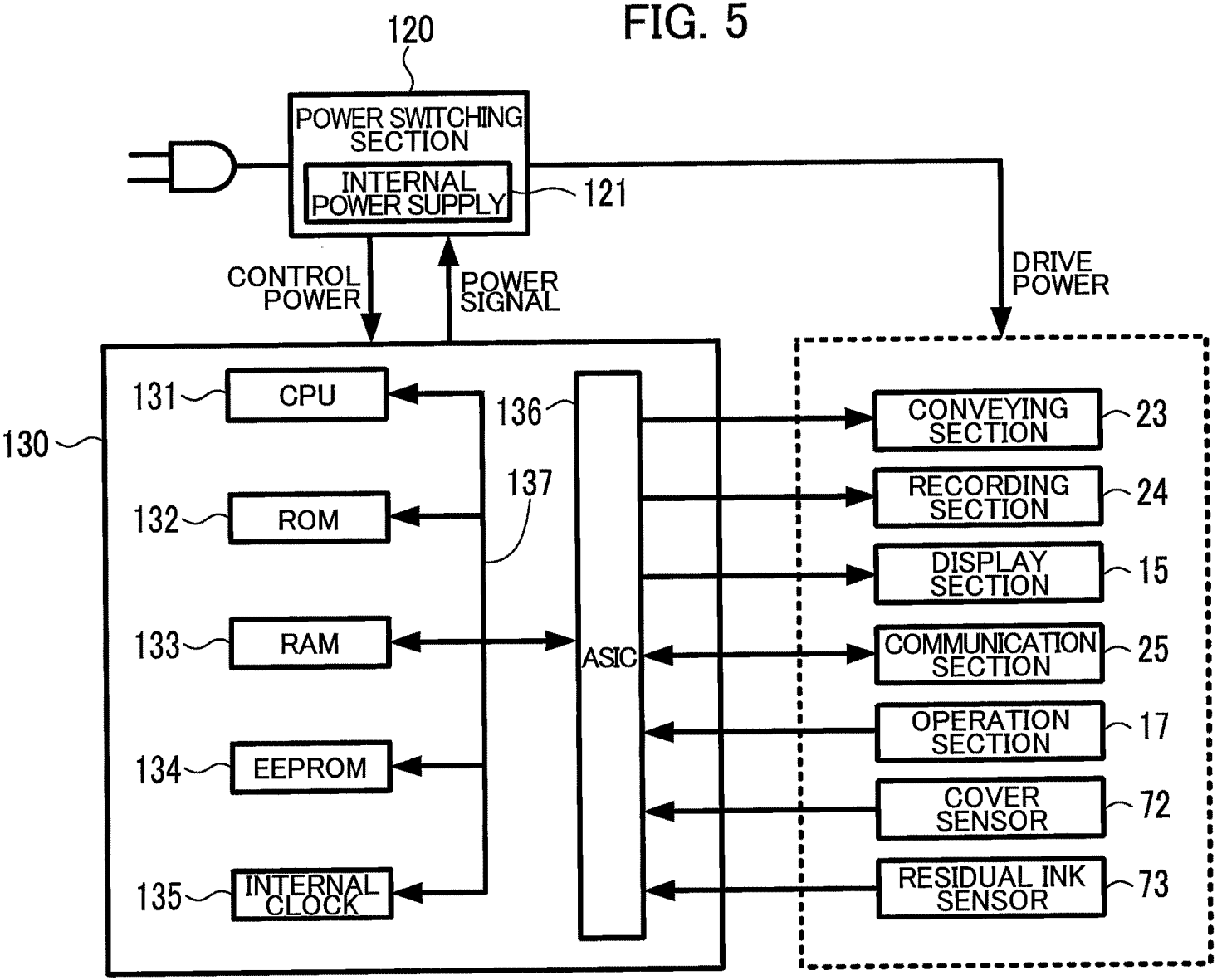
FIG. 5 is a functional block diagram of the MFP 10 according to the embodiment.

As illustrated in FIGS. 4 and 5, the MFP 10 also includes a residual ink sensor 73. The residual ink sensor 73 has the light-emitting portion 74 and a light-receiving portion 75. The light-emitting portion 74 and the light-receiving portion 75 are arranged to oppose each other in the left-right direction 9 with the ink detection portion 152 interposed therebetween. The light-emitting portion 74 is configured to output light (visible light or infrared light, for example) toward the light-receiving portion 75. The light can pass through walls constituting the ink detection portion 152 but not through black ink. The light-receiving portion 75 is configured to output a residual ink signal to the controller 130 based on whether the light-receiving portion 75 has received light outputted from the light-emitting portion 74 after the light passes through the ink detection portion 152. In other words, the residual ink sensor 73 is configured to output a residual ink signal to the controller 130 corresponding to the quantity of ink stored in the ink chamber 111B.

The residual ink sensor 73 according to the present embodiment is configured to output either a first residual ink signal or a second residual ink signal to the controller 130. The residual ink sensor 73 outputs the first residual ink signal in response to presence of ink at the detection position in the ink detection portion 152. On the other hand, the residual ink sensor 73 outputs the second residual ink signal in response to non-presence of ink at the detection position in the ink detection portion 152. In the present embodiment, the first residual ink signal outputted from the residual ink sensor 73 has a signal level of 0 V, while the second residual ink signal outputted from the residual ink sensor 73 has a signal level of 3.3 V. Hence, the phrase "the residual ink sensor 73 outputs a residual ink signal" includes cases in which the signal level is 0 V. However, combination of signal levels is not limited to the above example. Combination of position signals of a cover sensor 72 (described later) is also not limited to the example in the present embodiment.

The detection position is a position within the interior space of the ink detection portion 152 having a height in the up-down direction 7 the same as those of the light-emitting portion 74 and the light-receiving portion 75. The detection position in the up-down direction 7 is lower than the second line 147 and slightly higher than the interior space of the ink supply portion 151 when the MFP 10 is in its operable posture. Hence, the interior space of the ink supply portion 151 is filled with ink when the level of ink in the ink chamber 111B is aligned with the detection position. However, when the level of ink in the ink chamber 111B drops below the detection position, air introduced into the ink chamber 111B through the air communication portion 155 may enter the interior space of the ink supply portion 151. A difference in the up-down direction 7 between the detection position and the interior space in the ink supply portion 151 is preliminarily set based on an estimated quantity of ink required for recording an image on one sheet, for example.

Hence, the residual ink signal outputted from the residual ink sensor 73 switches from the first residual ink signal to the second residual ink signal at a timing in which the level of ink in the ink chamber 111B drops below the detection position. In the following description, a state of the ink chamber 111B when the residual ink sensor 73 outputs the second residual ink signal will be referred to as a "hard-empty" state. In other words, the term "hard-empty state" indicates a state of the ink chamber 111B just prior to air entering the interior space of the ink supply portion 151, for example. The hard-empty state is an example of a quantity of ink stored in the ink chamber 111B being less than a residual ink threshold. The residual ink threshold corresponds to the quantity of ink stored in the ink chamber 111B when the level of ink in the ink chamber 111B is at the detection position, for example.

Each of the tanks 100Y, 100C, and 100M may have a basic structure the same as that of the tank 100B. However, the tanks 100Y, 100C, and 100M are not provided with the ink detection portion 152. That is, the controller 130 cannot detect residual ink quantities in the corresponding ink chambers 111Y, 111C, and 111M using residual ink sensors 73. Hereinafter, the ink chambers 111B, 111Y, 111C, and 111M will be collectively referred to as the "ink chambers 111," the inlets 112B, 112Y, 112C, and 112M will be collectively referred to as the "inlets 112," and the caps 113B, 113Y, 113C, and 113M will be collectively referred to as the "caps 113."

<Cover 70>

As illustrated in FIG. 1B, the front surface of the casing 14 has a right end portion formed with an opening 22. The front surface of the ink tank 100 is exposed to an outside of the MFP 10 through the opening 22. The MFP 10 has the cover 70 that is pivotally movable between a covering position (a position illustrated in FIG. 1A) for covering the opening 22, and an exposing position (a position illustrated in FIG. 1B) for exposing the opening 22. The cover 70 is supported to the casing 14 at a bottom edge portion of the casing 14 so as to be pivotally movable about a pivot axis extending along the left-right direction 9.

In the covering position, the cover 70 covers all of the inlets 112B, 112Y, 112C, and 112M and restricts injection of ink into all of the ink chambers 111B, 111Y, 111C, and 111M through the inlets 112B, 112Y, 112C, and 112M. Here, the cover 70 in the covering position may be configured to cover the inlets 112 in their entirety or to cover just a portion of the inlets 112. When the cover 70 is in the exposing position, all of the inlets 112B, 112Y, 112C, and 112M are exposed outside the MFP 10, thereby allowing ink to be injected into all of the ink chambers 111B, 111Y, 111C, and 111M.

The user performs the following series of steps for filling the ink chambers 111 with ink. First, the user moves the cover 70 from the covering position to the exposing position and removes the cap 113 from the inlet 112 corresponding to the color of ink to be refilled. Next, the user inserts a tip of the ink bottle into the opened inlet 112 and injects all of ink in the ink bottle into the ink chamber 111. After the ink chamber 111 has been refilled, the user reattaches the cap 113 to the corresponding inlet 112 and moves the cover 70 back to the covering position.

The cover 70 has a transparent window 71. The transparent window 71 faces the front walls 101 of the tanks 100B, 100Y, 100C, and 100M when the cover 70 is in the covering position. With this configuration, the user can visually recognize the residual ink quantity of ink in the ink chambers 111 through the front walls 101, regardless of whether the cover 70 is in the covering position or the exposing position. On the other hand, the transparent window 71 may be omitted from the cover 70. In this case, the user must move the cover 70 to the exposing position in order to check the levels of ink in the ink chambers 111.

<Cover Sensor 72>

As illustrated in FIG. 5, the MFP 10 also includes the cover sensor 72. The cover sensor 72 may be a mechanical sensor, such as a switch that the cover 70 contacts and separates from, or an optical sensor for emitting light that is transmitted or interrupted depending on the position of the cover 70, for example. The cover sensor 72 is configured to output, to the controller 130, a position signal corresponding to the position of the cover 70.

The cover sensor 72 is configured to output either a first position signal or a second position signal to the controller 130. The first position signal outputted from the cover sensor 72 indicates that the cover 70 is in the covering position. The second position signal outputted from the cover sensor 72 indicates that the cover 70 is in a position other than the covering position (the exposing position, for example). In the present embodiment, the first position signal outputted from the cover sensor 72 has a signal level of 0 V, and the second position signal outputted from the cover sensor 72 has a signal level of 3.3. V. In the following description, an expression "cover open event" will be used to indicate that the position signal outputted from the cover sensor 72 has changed from the first position signal to the second position signal, while an expression "cover close event" will be used to indicate that the position signal outputted from the cover sensor 72 has changed from the second position signal to the first position signal.

<Display Section 15>

As illustrated in FIGS. 1A, 1B and 5, the MFP 10 also includes a display section 15. The display section 15 displays information for the user in the form of messages. While there are no particular limitations on the specific structure of the display section 15, a liquid crystal display or an organic electro-luminescence display may be employed as the display section 15, for example. The display section 15 is an example of a display.

The display section 15 according to the present embodiment has a rectangular shape with 8 dots vertically by 80 dots horizontally. Thus, the display section 15 can display a maximum of 16 characters (including spaces), each comprising 8 dots vertically by 5 dots horizontally (approximately 8 mm vertically by approximately 5 mm horizontally). Further, when attempting to display a character string exceeding 16 characters on the display section 15, the character string is displayed in a scrolling format. When attempting to display character strings in a plurality of lines on the display section 15, the character string for each line is displayed in sequence. However, the size of the display section 15 is not limited to the above example.

<Operation Section 17>

The MFP 10 also includes an operation section 17 for receiving user operations. The operation section 17 is an input interface that accepts input from a user indicating instructions for the MFP 10. The operation section 17 according to the present embodiment is configured of a plurality of push buttons, including a numeric keypad 17A and a power button 17B. However, the push buttons provided in the operation section 17 are not limited to the above example, and may include directional keys corresponding to "up", "down", "right", and "left". Further, the specific configuration of the operation section 17 is not limited to the push buttons, but may be a touchscreen superimposed over the display screen of the display section 15. The operation section 17 is an example of an operation interface.

The operation section 17 is configured to output, to the controller 130, operation signals corresponding to the push buttons that have been pressed. Specifically, the operation section 17 according to the present embodiment is configured to output a first operation signal, a second operation signal, and a third operation signal to the controller 130. The operation section 17 outputs the first operation signal to the controller 130 when the [1] button in the numeric keypad 17A has been pressed. The operation section 17 outputs the second operation signal to the controller 130 when the [2] button in the numeric keypad 17A has been pressed. The operation section 17 outputs the third operation signal to the controller 130 when the power button 17B has been pressed. The operation section 17 also outputs, to the controller 130, other operation signals corresponding to other buttons when the other buttons are pressed.

In the following description, an expression "the [1] button was pressed" will indicate that the operation section 17 outputted the first operation signal, an expression "the [2] button was pressed" will indicate that the operation section 17 outputted the second operation signal, and an expression "the power button 17B was pressed" will indicate that the operation section 17 outputted the third operation signal. Note that the buttons corresponding to the first operation signal, the second operation signal, and the third operation signal are not limited to the above example.

<Communication Section 25>

As illustrated in FIG. 5, the MFP 10 also includes a communication section 25. The communication section 25 is an interface through which the MFP 10 communicates with external devices. In other words, the MFP 10 is configured to transmit various data to external devices through the communication section 25 and to receive various data from external devices through the communication section 25. The communication section 25 may also function as a facsimile receiving section that receives facsimile data from external devices.

<Power Switching Section 120>

The MFP 10 also includes a power switching section 120. The power switching section 120 is configured to receive electric power from an external power source when the MFP 10 is plugged into the external power source, and to supply this electric power to various components in the MFP 10. More specifically, through the electric power acquired from the external power source, the power switching section 120 outputs drive power (24 V, for example) to the conveying section 23, the recording section 24, and the like and outputs control power (5 V, for example) to the controller 130. The power switching section 120 includes an internal power supply 121. The power switching section 120 charges the internal power supply 121 with part of the electric power supplied from the external power source.

The power switching section 120 can switch between a plug ON state and a plug OFF state. In the plug ON state, the MFP 10 is plugged into the external power source through an electric cable extending from the power switching section 120, and the MFP 10 receives electric power from the external power source through the plug. In the plug OFF state, the MFP 10 is unplugged, and the power switching section 120 does not receive electric power from the external power source. Hence, the power switching section 120 charges the internal power supply 121 with some of the electric power supplied from the external power source during the plug ON state, but does not charge the internal power supply 121 during the plug OFF state.

The power switching section 120 in the plug ON state can switch between a switch ON state and a switch OFF state based on a power signal outputted from the controller 130. When the power switching section 120 is in the switch OFF state, the controller 130 switches the power switching section 120 to the switch ON state in response to pressing of the power button 17B. Similarly, when the power switching section 120 is in the switch ON state, the controller 130 switches the power switching section 120 to the switch OFF state in response to pressing of the power button 17B.

In the switch OFF state, the power switching section 120 still supplies electric power to the controller 130 and the operation section 17, but does not supply electric power to the conveying section 23, the recording section 24, the display section 15, the communication section 25, the cover sensor 72, and the residual ink sensor 73. In other words, the controller 130 and the operation section 17 can still operate during the switch OFF state, but the conveying section 23, the recording section 24, the display section 15, the communication section 25, the cover sensor 72, and the residual ink sensor 73 are inoperable during the switch OFF state. During the switch ON state, electric power is supplied to the greater number of components of the MFP 10 than during the switch OFF state.

During the switch ON state, the power switching section 120 can switch between a drive state and an idle state based on a power signal outputted from the controller 130. The controller 130 switches the power switching section 120 from the idle state to the drive state when an operation is performed on the operation section 17 or when the controller 130 receives information through the communication section 25. The controller 130 switches the power switching section 120 from the drive state to the idle state when the operation section 17 has not been operated and the controller 130 has not received information through the communication section 25 for a prescribed time interval.

In the drive state, the power switching section 120 supplies electric power to all of the components in the MFP 10. In other words, all of the components in the MFP 10 are operable in the drive state. In the idle state, the power switching section 120 supplies electric power to the controller 130, the operation section 17, the communication section 25, the cover sensor 72, and the residual ink sensor 73, but does not supply electric power to the display section 15, the conveying section 23, the recording section 24. Hence, the controller 130, the operation section 17, the communication section 25, the cover sensor 72, and the residual ink sensor 73 are operable in the idle state, but the conveying section 23, the recording section 24, and the display section 15 are inoperable in the idle state.

<Controller 130>

As illustrated in FIG. 5, the controller 130 includes a central processing unit (CPU) 131, a read-only memory (ROM) 132, a random-access memory (RAM) 133, an electrically erasable programmable ROM (EEPROM) 134, and an application-specific integrated circuit (ASIC) 136. The CPU 131, the ROM 132, the RAM 133, the EEPROM 134, and the ASIC 136 are interconnected with one another via an internal bus 137. The ROM 132 stores programs and the like with which the CPU 131 controls various operations. The RAM 133 is used as a storage area for temporarily storing data, signals, and the like used when the CPU 131 executes the above programs, or as a work area for data processes. The EEPROM 134 stores settings, flags, and the like that must be preserved even during the plug OFF state. The ROM 132, the RAM 133, and the EEPROM 134 are examples of a memory.

The EEPROM 134 stores a count value for each of the ink chambers 111B, 111Y, 111C, and 111M. The count value in the present embodiment is set to an initial value (for example, 0) in steps S46, S78, and S86 (described later) and is incremented in S16 (described later) based on the quantity of ink ejected from the recording section 24. In the following description, the count value for the ink chamber 111B will be referred to as the "count value B," the count value for the ink chamber 111Y will be referred to as the "count value Y," the count value for the ink chamber 111C will be referred to as the "count value C," and the count value for the ink chamber 111M will be referred to as the "count value M."

The EEPROM 134 also stores a first threshold value and a second threshold value for each of the ink chambers 111B, 111Y, 111C, and 111M. The first threshold value is set to a slightly smaller value (95, for example) than the maximum storage quantity (100, for example) of ink that can be stored in the corresponding ink chamber 111, for example. A difference between the maximum storage quantity and the first threshold value for the ink chamber 111B is equivalent to the residual ink threshold, for example. The second threshold value is set to a value (85, for example) closer to the initial value of the count value than the first threshold value is to the initial value. A difference between the maximum storage quantity and the second threshold value is equivalent to the quantity of ink stored in the corresponding ink chamber 111 when the level of ink in the ink chamber 111 is aligned with the second line 147, for example.

In the following description, a state of the ink chamber 111 when the difference between the first threshold value and the corresponding count value (first threshold value−count value) is less than 0 will be referred to as a "soft-empty" state. Further, a state of the ink chamber 111 when the difference between the second threshold value and the corresponding count value (second threshold value−count value) is less than 0 will be referred to as an "ink low" state. Hence, the ink chamber 111 arrives at the ink low state prior to the soft-empty state. Ideally or theoretically, a timing at which the ink chamber 111 reaches the soft-empty state is equivalent to a timing at which the ink chamber 111 reaches the hard-empty state. The difference between the first threshold value and the count value and the difference between the second threshold value and the count value may be used as estimation values of the quantity of ink remaining in the corresponding ink chamber 111. The soft-empty state is an example of a quantity of ink stored in the ink chamber 111 being less than the residual ink threshold.

Note that the count value, the first threshold value, and the second threshold value are not limited to the relationships described above. As an alternative example, the count value may be set to an initial value (100, for example) in steps S46, S78, and S86, and may be decremented in S16 based on the quantity of ink ejected from the recording section 24. Here, the first threshold value may be set to a smaller value (5, for example) than the second threshold value (15, for example). In this variation, the soft-empty state is determined based on (count value−first threshold value), and the ink low state is determined based on (count value−second threshold value).

In other words, the count value should be updated in S16 in a direction approaching the first threshold value. Here, the expression "a direction approaching the first threshold value" represents the relationship between the count value and the first threshold value when the count value has been set to its initial value. That is, an incremented count value is continuously incremented, even after reaching the first threshold value. Similarly, a decremented count value is continuously decremented, even after reaching the first threshold value. Further, the second threshold value should be set to a value at which its difference with the count value reaches 0 before the difference between the count value and the first threshold value reaches 0.

The EEPROM 134 also stores a restart count value for each of the ink chambers 111B, 111Y, 111C, and 111M. The restart count value is an example of a switching-point count value. In the present embodiment, the restart count value is set to an initial value (null, for example) in S61 of a cover open process described later, and is overwritten by a corresponding count value in S32 of a switch ON process described later. The initial value for the restart count value is an example of an invalid value to which the count value cannot be set. In the following description, the restart count value corresponding to the ink chamber 111B is referred to as "restart count value B"; the restart count value corresponding to the ink chamber 111Y is referred to as "restart count value Y"; the restart count value corresponding to the ink chamber 111C is referred to as "restart count value C"; and the restart count value corresponding to the ink chamber 111M is referred to as "restart count value M."

The EEPROM 134 also stores a soft-empty flag, an ink low flag, and a restart ink low flag for each of the ink chambers 111B, 111Y, 111C, and 111M. The soft-empty flag is information indicating whether the corresponding ink chamber 111 is in the soft-empty state. The soft-empty flag is set to either a value "ON" corresponding to the soft-empty state or a value "OFF" corresponding to a non-soft-empty state. The ink low flag is information indicating whether the corresponding ink chamber 111 is in the ink low state. The ink low flag is set to either a value "ON" corresponding to the ink low state or a value "OFF" corresponding to a non-ink-low state. The restart ink low flag is information indicating whether the corresponding ink chamber 111 is in the ink low state at a time that the power switching section 120 is switched to the switch ON state. The restart ink low flag is set to either a value "ON" indicating that the corresponding ink chamber 111 was in the ink low state at a time that the power switching section 120 is switched to the switch ON state, or a value "OFF" indicating that the corresponding ink chamber 111 was in the ink low state when the power switching section 120 is switched to the switch ON state.

The soft-empty flag according to the present embodiment is set to "ON" when the difference between the first threshold value and the corresponding count value is less than 0 in S16, and is set to "OFF" in steps S76, S78, and S86, for example. The ink low flag according to the present embodiment is set to "ON" when the difference between the second threshold value and the corresponding count value is less than 0 in S16, and is set to "OFF" in steps S76, S78, and S86, for example. The restart ink low flag according to the present embodiment is set to the setting for the corresponding ink low flag in S34, and is set to "OFF" in S61, for example. The initial values of the soft-empty flag, the ink low flag, and the restart ink low flag are "OFF".

The EEPROM 134 also stores a hard-empty flag. The hard-empty flag is information indicating whether the ink chamber 111B has entered the hard-empty state the last time ink was ejected from the recording section 24. The hard-empty flag is set to either a value "ON" corresponding to the hard-empty state or a value "OFF" corresponding to a non-hard-empty state. The hard-empty flag according to the present embodiment is set to "ON" during image recording in S15 described later when the residual ink signal outputted from the residual ink sensor 73 switches from the first residual ink signal to the second residual ink signal, and is set to "OFF" in steps S76, S78, and S86, for example. The initial value of the hard-empty flag is "OFF".

The EEPROM 134 also stores a restart hard-empty flag. The restart hard-empty flag is information indicating whether the ink chamber 111B is in a hard-empty state at a time that the power switching section 120 is switched to the switch ON state. The restart hard-empty flag is set to either "ON" indicating that the ink chamber 111B was in a hard-empty state at a time the power switching section 120 changed to the switch ON state, or "OFF" indicating that the ink chamber 111B was not in a hard-empty state when the power switching section 120 changed to the switch ON state. In the present embodiment, the restart hard-empty flag is set to a value corresponding to the residual ink signal during step S35 of the switch ON process described later and is set to "OFF" in S61 of the cover open process described later. The initial value of the restart hard-empty flag is "OFF".

In the following description, the soft-empty flag, the ink low flag, and the restart ink low flag corresponding to the ink chamber 111B will be referred to as the "soft-empty flag B," the "ink low flag B," and the "restart ink low flag B," respectively; the soft-empty flag, the ink low flag, and the restart ink low flag corresponding to the ink chamber 111Y will be referred to as the "soft-empty flag Y," the "ink low flag Y," and the "restart ink low flag Y," respectively; the soft-empty flag, the ink low flag, and the restart ink low flag corresponding to the ink chamber 111C will be referred to as the "soft-empty flag C," the "ink low flag C," and the "restart ink low flag C," respectively; the soft-empty flag, the ink low flag, and the restart ink low flag corresponding to the ink chamber 111M will be referred to as the "soft-empty flag M," the "ink low flag M," and the "restart ink low flag," respectively. The hard-empty flag indicates the state of the ink chamber 111B, since the residual ink sensor 73 and the ink detection portion 152 are only provided for the tank 100B in the present embodiment. Hence, the soft-empty flag B may be omitted in this case.

The EEPROM 134 also stores a switch-on count N. The switch-on count N is an example of a switching count indicative of the number of times that the power switching section 120 has been switched to a switch ON state. More specifically, the switch-on count N is the number of times that the power switching section 120 changed to a switch ON state after step S32 is performed in the switch ON process. In the present embodiment, the switch-on count N is set to an initial value (0, for example) in S36 of the switch ON process described later and is incremented by 1 each time process in S37 is executed, for example.

Further, the conveying section 23, the recording section 24, the display section 15, the communication section 25, the operation section 17, the cover sensor 72, and the residual ink sensor 73 are connected to the ASIC 136. The controller 130 controls the conveying section 23 to convey sheets, controls the recording section 24 to eject ink, controls the display section 15 to display screens, and controls the communication section 25 to communicate with external devices. Further, the controller 130 acquires operation signals from the operation section 17, acquires position signals from the cover sensor 72, and acquires residual ink signals from the residual ink sensor 73. As an example, the controller 130 may read the position signal outputted from the cover sensor 72 and the residual ink signal outputted from the residual ink sensor 73 at prescribed time intervals (every 50 msec, for example).

The controller 130 also includes an internal clock 135 (otherwise known as a hardware clock) that outputs time information. The internal clock 135 is updated by electric power supplied from the external power source through the power switching section 120 when the power switching section 120 is in the plug ON state (i.e., in any of the switch OFF state, the switch ON state, the idle state, and the drive state). When the power switching section 120 is in the plug OFF state, on the other hand, the internal clock 135 is updated by electric power supplied from the internal power supply 121. When the charge in the internal power supply 121 is depleted, the time information outputted from the internal clock 135 is reset to an initial value (a null value, for example).

<Operation of MFP 10>

Next, operations of the MFP 10 according to the present embodiment will be described with reference to FIGS. 6 through 10. The CPU 131 of the controller 130 executes all processes described in FIGS. 6 through 10. Note that, to implement the following processes, the CPU 131 may read and execute a program stored in the ROM 132. Alternatively, the following processes may be implemented by hardware circuits mounted in the controller 130.

<Image Recording Process>

Figure 6:
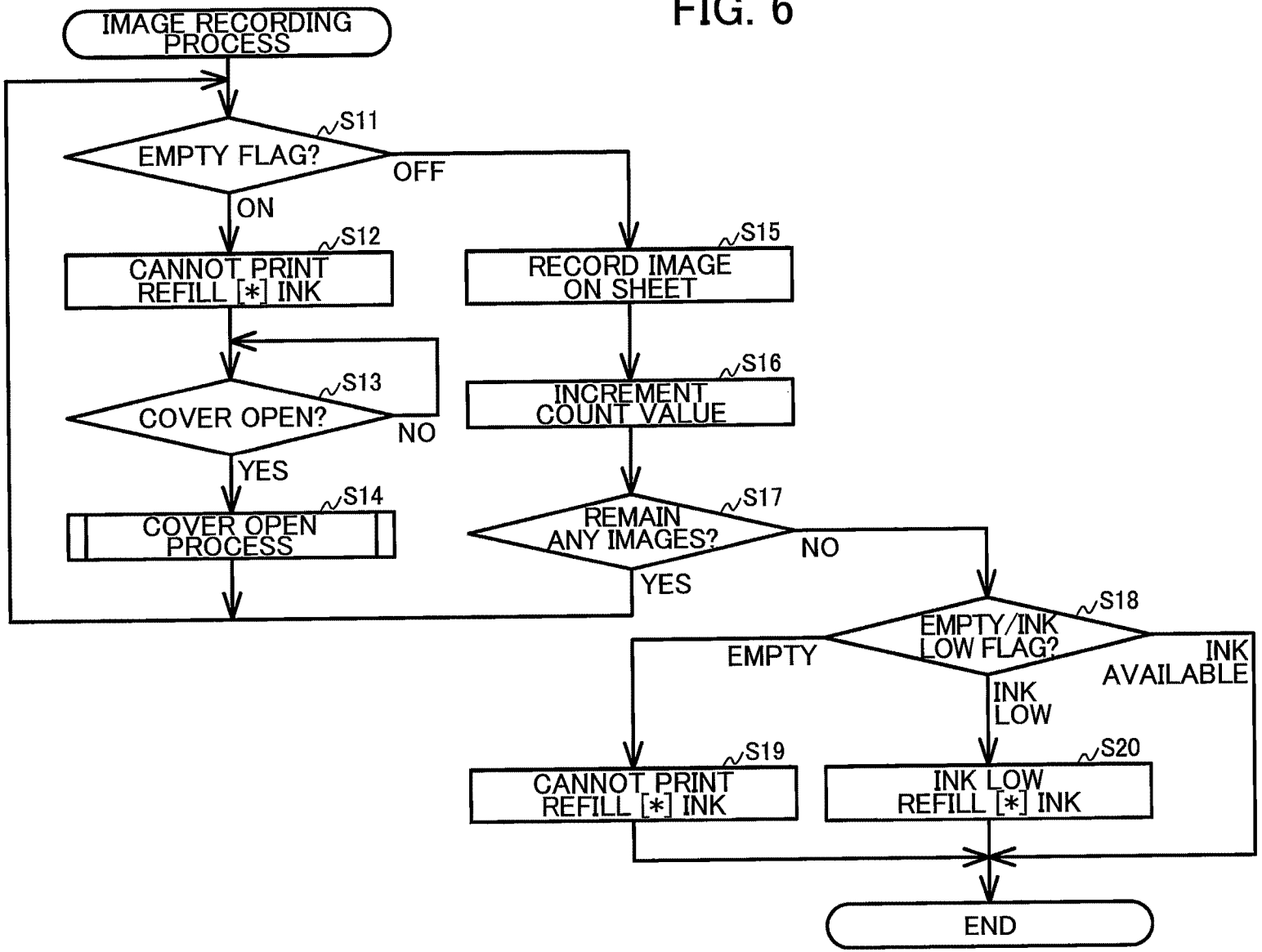
FIG. 6 is a flowchart illustrating steps in an image recording process executed by a controller 130 of the MFP 10 according to the embodiment.

The controller 130 executes the image recording process illustrated in FIG. 6 based on a recording instruction that is inputted into the MFP 10. The recording instruction is an instruction to the MFP 10 to execute a recording process for recording images on sheets based on image data. While there is no particular limitation on the source for acquiring the recording instruction, the recording instruction may be acquired from the user through the operation section 17 or may be acquired from an external device through the communication section 25, for example. In addition, the recording instruction may instruct the MFP 10 to record images on sheets based on fax data.

In S11 at the beginning of the image recording process in FIG. 6, the controller 130 determines the settings for the hard-empty flag and the soft-empty flags Y, C, and M. Specifically, the controller 130 determines whether at least one of the hard-empty flag and the soft-empty flags Y, C, and M is set to "ON" (S11: ON) or whether all of the hard-empty flag and the soft-empty flags Y, C, and M are set to "OFF" (S11: OFF). In response to the determination that at least one of the hard-empty flag and the soft-empty flags Y, C, and M is set to "ON" (S11: ON), in S12 the controller 130 controls the display section 15 to display an empty notification screen on the display section 15.

The empty notification screen is a notification screen for notifying the user that the recording process cannot be executed until ink has been refilled. More specifically, a character string "CANNOT PRINT" and a character string "REFILL [*] INK" are alternately displayed in the empty notification screen. Here, "[*]" is replaced with characters representing the colors of ink stored in the ink chambers 111. For example, the controller 130 may include characters in the empty notification screen that represent the colors of ink stored in ink chambers 111 whose corresponding hard-empty flag and soft-empty flags Y, C, and M have been set to "ON". The controller 130 controls the display section 15 to continuously display the empty notification screen on the display section 15 until the controller 130 detects the cover open event through the cover sensor 72 (S13: NO).

Next, the controller 130 detects the cover open event through the cover sensor 72 and executes the cover open process (described later, S14) in response to the detection of the cover open event through the cover sensor 72 (S13: YES). The cover open process is performed to prompt the user to indicate whether the ink chambers 111 were refilled and to initialize the corresponding count values, hard-empty flag and soft-empty flags, ink low flags, and the like based on the user's responses. After completing the cover open process, the controller 130 repeats the process from S11. If any of the hard-empty flag and the soft-empty flags Y, C, and M is still set to "ON" after executing the cover open process (S11: ON), the controller 130 repeats the process from S12.

On the other hand, in response to the determination that all of the hard-empty flag and the soft-empty flags Y, C, and M have been set to "OFF" (S11: OFF), in S15 the controller 130 records images on sheets based on image data included in the recording instruction. Thus, the recording section 24 can eject ink when all of the hard-empty flag and the soft-empty flags Y, C, and M have been set to "OFF", but cannot eject ink when even one of the hard-empty flag and the soft-empty flags Y, C, and M has been set to "ON".

More specifically, in S15 the controller 130 controls the conveying section 23 to convey a sheet supported in the feed tray 20 to a position facing the recording section 24. Next, the controller 130 controls the recording section 24 to eject ink toward the sheet facing the recording section 24 to record an image on the sheet. Subsequently, the controller 130 controls the conveying section 23 to discharge the sheet having an image recorded by the recording section 24 into the discharge tray 21.

In addition, in S16 the controller 130 counts the quantity of ink ejected from the recording section 24 in S15 for each color and increments the corresponding count value. Note that the timing for incrementing the count values is not limited to the timing of S16. Any time ink is ejected from the recording section 24, the controller 130 increments the corresponding count values based on the quantities of ink ejected from the recording section 24, such as in a flushing process in which the recording section 24 ejects ink toward an ink receptor (not illustrated), or a maintenance process.

Here, the controller 130 sets the hard-empty flag to "ON" when the residual ink signal outputted from the residual ink sensor 73 switches from the first residual ink signal to the second residual ink signal while the recording section 24 ejects ink. Further, when the difference between any count value and the corresponding second threshold value becomes less than 0 while the count values are incremented, the controller 130 sets the corresponding ink low flag to "ON". In other words, when a difference between the second threshold value and a first initial value (described later) of the corresponding count value becomes a value less than the difference between the count value and the first initial value, the ink low flag is set to "ON". Further, when the difference between any count value and the corresponding first threshold value becomes less than 0 while the count values are incremented, the controller 130 sets the corresponding soft-empty flag to "ON". In other words, when a difference between the first threshold value and the first initial value of the corresponding count value becomes a value less than the difference between the count value and the first initial value, the soft-empty flag is set to "ON".

In S17 the controller 130 determines whether there remain any images indicated in the recording instruction that have not been recorded on sheets. Until the controller 130 records all images indicated in the recording instruction on sheets (S17: YES), the controller 130 returns to S11 and repeats the process in S11-S16 described above. After all images indicated in the recording instruction have been recorded on sheets (S17: NO), in S18 the controller 130 determines the settings for the hard-empty flag, the soft-empty flags Y, C, and M, and the ink low flags B, Y, C, and M.

In response to determination that any one of the hard-empty flag and the soft-empty flags Y, C, and M has been set to "ON" (S18: Empty), in S19 the controller 130 controls the display section 15 to display the empty notification screen on the display section 15. However, in response to the determination that all of the hard-empty flag and the soft-empty flags Y, C, and M have been set to "OFF" but any one of the ink low flags B, Y, C, and M has been set to "ON" (S18: Ink low), in S20 the controller 130 controls the display section 15 to display an ink low notification screen on the display section 15.

The empty notification screen displayed in S19 may be identical to that displayed in S12. The ink low notification screen is a screen for notifying the user that the ink chamber 111 is approaching the soft-empty state. Specifically, a character string "INK LOW" and a character string "REFILL [*] INK" are alternately displayed in the ink low notification screen. Here, "[*]" is replaced with characters representing the colors of ink stored in ink chambers 111 in the ink low state.

The controller 130 controls the display section 15 to continuously display the empty notification screen or the ink low notification screen on the display section 15 until one of the following events occurs: the cover open event is detected through the cover sensor 72, the recording instruction is inputted, the operation section 17 is operated, or the state of the power switching section 120 changes to a state other than the drive state (i.e., the idle state, the switch OFF state, or the plug OFF state). On the other hand, in response to determination that all of the hard-empty flag, the soft-empty flags Y, C, and M, and the ink low flags B, Y, C, and M are set to "OFF" (S18: Ink available), the controller 130 ends the image recording process without executing either of the processes in S19 or S20.

<Switch ON Process>

Next, the switch ON process will be described with reference to FIG. 7A. The controller 130 executes the switch ON process when the power switching section 120 is switched to the switch ON state. In the example described in the present embodiment, the plug on the electric cable of the power switching section 120 is removed from the power outlet while the power switching section 120 is in a switch ON state, and is subsequently reinserted into the outlet.

Note that when the plug is removed from the outlet, the controller 130 according to the embodiment switches the power switching section 120 to both the plug OFF state and the switch OFF state. When the plug is reinserted into the outlet, the controller 130 switches the power switching section 120 back to the plug ON state and the switch ON state. Hence, in this example, the switch OFF state may be rephrased as the plug OFF state, a switch OFF time described later may be rephrased as a plug OFF time, a switch ON time described later may be rephrased as a plug ON time, and a switch OFF interval $T_2$ described later may be rephrased as a plug OFF interval.

As a variation, the controller 130 may switch the power switching section 120 from its plug OFF state to a plug ON state and a switch OFF state when the plug is inserted into the outlet. Thereafter, the controller 130 may change the power switching section 120 from the switch OFF state to the switch ON state in response to pressing of the power button 17B. In this case, the switch OFF interval $T_2$ is greater than the plug OFF interval by an amount of elapsed time between the plug being inserted into the outlet and the power button 17B being pressed.

While the power switching section 120 is in the switch ON state, the controller 130 repeatedly acquires time information from the internal clock 135 at prescribed intervals (every second, for example) and stores this acquired time information in the EEPROM 134 as switch OFF time information. In other words, the switch OFF time information stored in the EEPROM 134 just before the power switching section 120 is switched from the switch ON state to the switch OFF state indicates the time at which the power switching section 120 changes to the switch OFF state.

Figure 7:
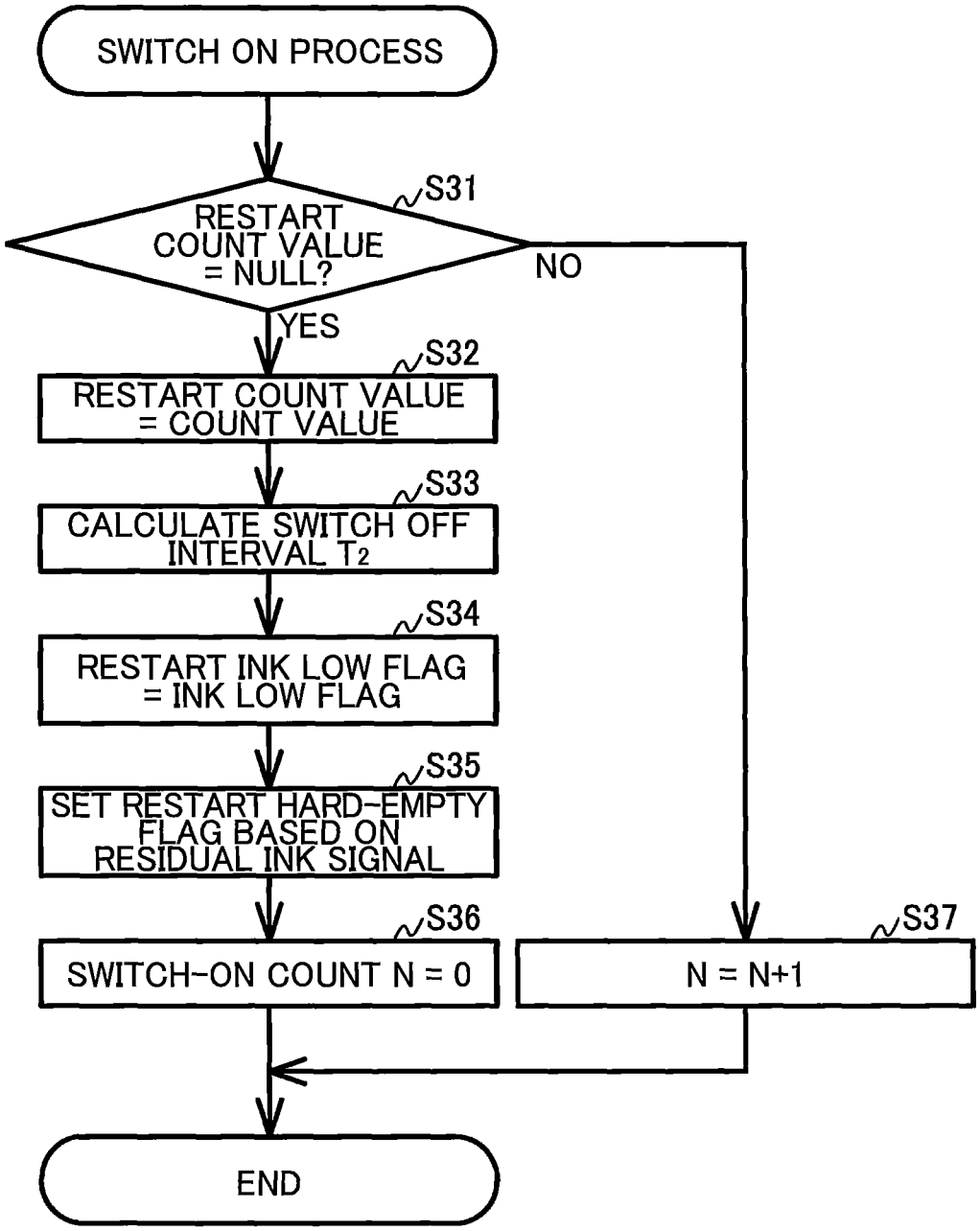
FIG. 7 is a flowchart illustrating steps in a switch ON process executed by the controller 130.

In S31 at the beginning of the switch ON process in FIG. 7, the controller 130 determines whether the restart count values are set to the null value in response to switch of the power switching section 120 to the switch ON state. In response to the determination that all of the restart count values B, Y, C, and M are set to null (S31: YES), in S32 the controller 130 sets all of the restart count values B, Y, C, and M to their corresponding count values. The process in S31 is an example of a second determination process, and the process in S32 is an example of a storing process.

In S33 the controller 130 calculates the switch OFF interval $T_2$. The switch OFF interval $T_2$ is an example of a non-powered time duration during which the power switching section 120 is in the switch OFF state. In other words, the switch OFF interval $T_2$ is a continuous time interval during which electric power is not supplied to the recording section 24 and the display section 15. For example, the controller 130 acquires time information for the time at which the power switching section 120 enters the switch ON state from the internal clock 135 as switch ON time information. Next, the controller 130 calculates the switch OFF interval $T_2$ to be the difference between the switch ON time indicated by the switch ON time information and the switch OFF time indicated by the switch OFF time information stored in the EEPROM 134.

In S34 the controller 130 sets all of the restart ink low flags B, Y, C, and M to the settings of the corresponding ink low flags. In other words, when a difference between the second threshold value and the first initial value of the corresponding count value is greater than or equal to a difference between the restart count value and the first initial value, the controller 130 sets the corresponding restart ink low flag to "OFF". When a difference between the second threshold value and the corresponding first initial value is less than a difference between the restart count value and the first initial value, the controller 130 sets the corresponding restart ink low flag to "ON". In S35 the controller 130 sets the restart hard-empty flag to a value based on the residual ink signal received at the time the power switching section 120 entered the switch ON state. In S36 the controller 130 also sets the switch-on count N to an initial value (0). The process in S36 is an example of a fourth initialization process.

However, in response to the determination that all of the restart count values B, Y, C, and M are set to a value (an example of a valid value) different from the initial value (S31: NO), in S37 the controller 130 increments the switch-on count N by 1 without executing the processes in S32-S36. The process in S37 is an example of a incrementing process.

<Cover Open Process>

Next, the cover open process will be described with reference to FIG. 8. The controller 130 executes the cover open process in response to detection of the cover open event through the cover sensor 72.

Figure 8:
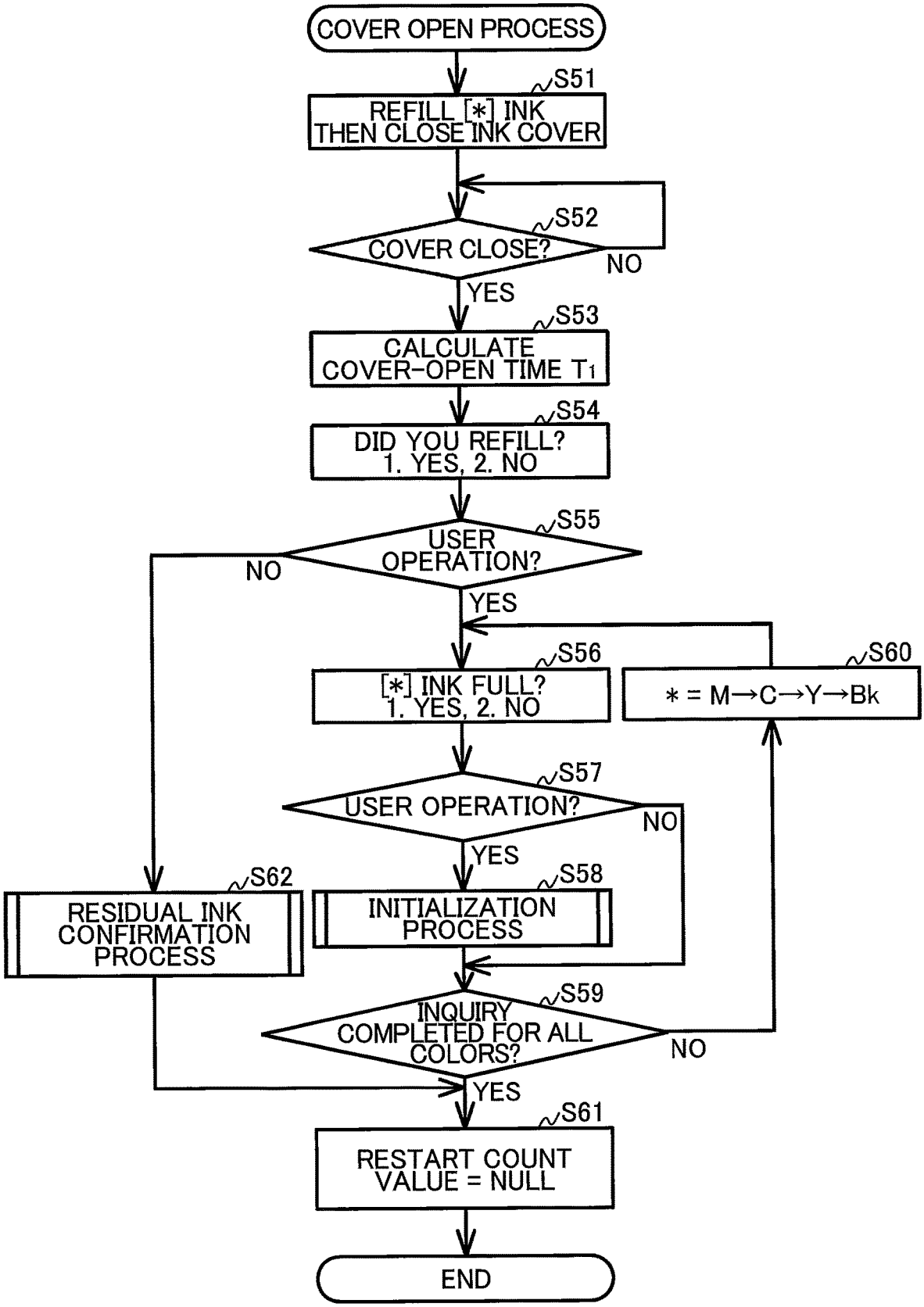
FIG. 8 is a flowchart illustrating steps in a cover open process executed by the controller 130.

In S51 at the beginning of the cover open process in FIG. 8, the controller 130 controls the display section 15 to display a refill notification screen on the display section 15. For example, a character string "REFILL [*] INK" and a character string "THEN CLOSE INK COVER" are alternately displayed in the refill notification screen. Here, "[*]" is replaced with characters representing the colors of ink that need to be refilled (Bk, Y, C, and M). The controller 130 may include, in the refill notification screen, characters representing the colors of ink stored in ink chambers 111 in the ink low state. The controller 130 controls the display section 15 to continuously display the refill notification screen on the display section 15 until the controller 130 detects the cover close event through the cover sensor 72 (S52: NO). In addition, the controller 130 acquires first time information indicative of the date and time that the cover open event was detected from the internal clock 135 and stores this first time information in the RAM 133.

When viewing the refill notification screen, the user removes the cap 113 from the inlet 112 of the ink chamber 111 to be refilled and injects ink into the ink chamber 111. After refilling the ink chamber 111, the user closes the inlet 112 with the cap 113 and moves the cover 70 back to the covering position. At this time, the user may perform only an injection of ink of the color indicated in the refill notification screen, may inject ink of all colors, or may not inject ink of any color. However, the controller 130 cannot detect what colors of ink were replenished.

In response to the detection of the cover close event through the cover sensor 72 (S52: YES), in S53 the controller 130 calculates a cover-open time $T_1$. The cover-open time $T_1$ is a time interval during which the cover 70 has been in the exposing position. In other words, the cover-open time $T_1$ is a time during which the cover sensor 72 has continuously outputted the second position signal. To calculate the cover-open time $T_1$, the controller 130 acquires, from the internal clock 135, second time information indicative of time that the cover close event is detected and subtracts the time indicated by the second time information from the time indicated by the first time information, for example.

In S54 the controller 130 controls the display section 15 to display a preliminary inquiry screen on the display section 15. The preliminary inquiry screen prompts the user to indicate whether at least one of the ink chambers 111 has been refilled. For example, a character string "DID YOU REFILL?" and a character string "1. YES, 2. NO" are alternately displayed in the preliminary inquiry screen. The controller 130 controls the display section 15 to continuously display the preliminary inquiry screen on the display section 15 until a first operation or a second operation has been received through the operation section 17 (S55).

The first operation is a user operation for indicating that at least one of the ink chambers 111 has been refilled with ink, and corresponds to pressing the [1] button, for example. The second operation is a user operation for indicating that none of the ink chambers 111 has been refilled with ink, and corresponds to pressing the [2] button, for example. The process in S54 and S55 is an example of a first inquiry process. Here, the controller 130 may execute the process from S54 when the cover-open time $T_1$ calculated in S53 is greater than or equal to a first interval. On the other hand, the controller 130 may end the cover open process without executing the process from S54 to S61 when the cover-open time $T_1$ calculated in S53 is less than the first interval.

In response to the pressing of the [1] button while the preliminary inquiry screen is displayed on the display section 15 (S55: YES), in S56 the controller 130 controls the display section 15 to display a first inquiry screen on the display section 15 that targets the ink chamber 111M. The first inquiry screen prompts the user to indicate whether the ink chamber 111M has been filled with ink up to the level of its maximum storage quantity. For example, a character string "M INK FULL?" and a character string "1. YES, 2. NO" are alternately displayed in the first inquiry screen. The controller 130 controls the display section 15 to continuously display the first inquiry screen on the display section 15 until a fifth operation or a sixth operation is received through the operation section 17 (S57).

The fifth operation is a user operation for indicating that the ink chamber 111M has been refilled with ink up to the level of its maximum storage quantity, and corresponds to pressing the [1] button, for example. The sixth operation is a user operation either for indicating that the ink chamber 111M has been refilled with ink but not up to the level of its maximum storage quantity in a case where the [1] button is pressed in S22 and, of the ink chambers 111, the ink chamber 111M has been refilled or for indicating that the ink chamber 111M has not been refilled in a case where the [1] button is pressed in S22 but any of the ink chambers 111 other than the ink chamber 111M has been refilled. The sixth operation corresponds to pressing the [2] button, for example.

Note that the first operation and the fifth operation may correspond to pressing the same button or may correspond to pressing different buttons. This is also true for the second operation and the sixth operation.

In response to the pressing of the [1] button while the first inquiry screen targeting the ink chamber 111M is displayed on the display section 15 (S57: YES), in S58 the controller 130 executes an initialization process described later. On the other hand, in response to pressing of the [2] button while the first inquiry screen targeting the ink chamber 111M is displayed on the display section 15 (S57: NO), the controller 130 skips the process in S58 and advances to S59.

In S59 the controller 130 determines whether the process in S56-S58 has been completed for all colors of ink. In response to determination that the process in S56-S58 has not been performed for all colors (S59: NO), in S60 the controller 130 sets the target color to the next color in the sequence M→C→Y→Bk. In this way, the process in S56-S58 is repeated for each of the ink chambers 111M, 111C, 111Y, and 111B. While repeating the process in S56-S58, the controller 130 executes the initialization process for the corresponding ink chamber 111 in response to the pressing of the [1] button, but does not execute the initialization process in response to the pressing of the [2] button.

Further, when executing the process in S56-S58 targeting the ink chamber 111B, the controller 130 may also determine whether the ink chamber 111B is currently in the hard-empty state in response to pressing of the [1] button while the first inquiry screen is displayed (S57: YES). The controller 130 may execute the initialization process for the ink chamber 111B in response to the determination that the ink chamber 111B is currently not in the hard-empty state. On the other hand, in response to the determination that the ink chamber 111B is currently in the hard-empty state, the controller 130 may skip the initialization process for the ink chamber 111B and jump to S59.

After the controller 130 has completed the process in S56-S58 for all ink chambers 111 (S59: YES), in S61 the controller 130 sets all restart count values to their initial value (null) and sets the restart hard-empty flag and all of the restart ink low flags to "OFF". The process in S61 is an example of a third initialization process. Note that the sequence in which the controller 130 performs the process in S56-S58 for ink chambers 111M, 111C, 111Y, and 111B is not limited to the above example. Further, in response to the pressing of the [2] button while the preliminary inquiry screen is displayed on the display section 15 (S55: NO), the controller 130 executes a residual ink confirmation process in S62 (described later) and the process in S61 without executing the process in S56-S60 even one time.

<Initialization Process>

Next, the initialization process performed for the ink chamber 111M will be described in detail with reference to FIG. 9. The initialization process serves to initialize values including the count value, the restart count value, the hard-empty flag, the soft-empty flag, the ink low flag, and the restart ink low flag. The initialization process is similar for the ink chambers 111C, 111Y, and 111B. In the present embodiment, the controller 130 sets the hard-empty flag to its initial value only for the ink chamber 111B.

In S71-S75 at the beginning of the initialization process, the controller 130 first infers whether the ink chamber 111M was refilled just before the first inquiry process (and specifically, between the preceding cover open event and cover close event) or whether the ink chamber 111M was refilled while the power switching section 120 was in the switch OFF state. The process in S71-S75 is an example of a first determination process. Note that the controller 130 need not execute all of the processes in S71-S75, but should execute at least one of these processes. In other words, some of the steps in S71-S75 may be omitted.

Figure 9:
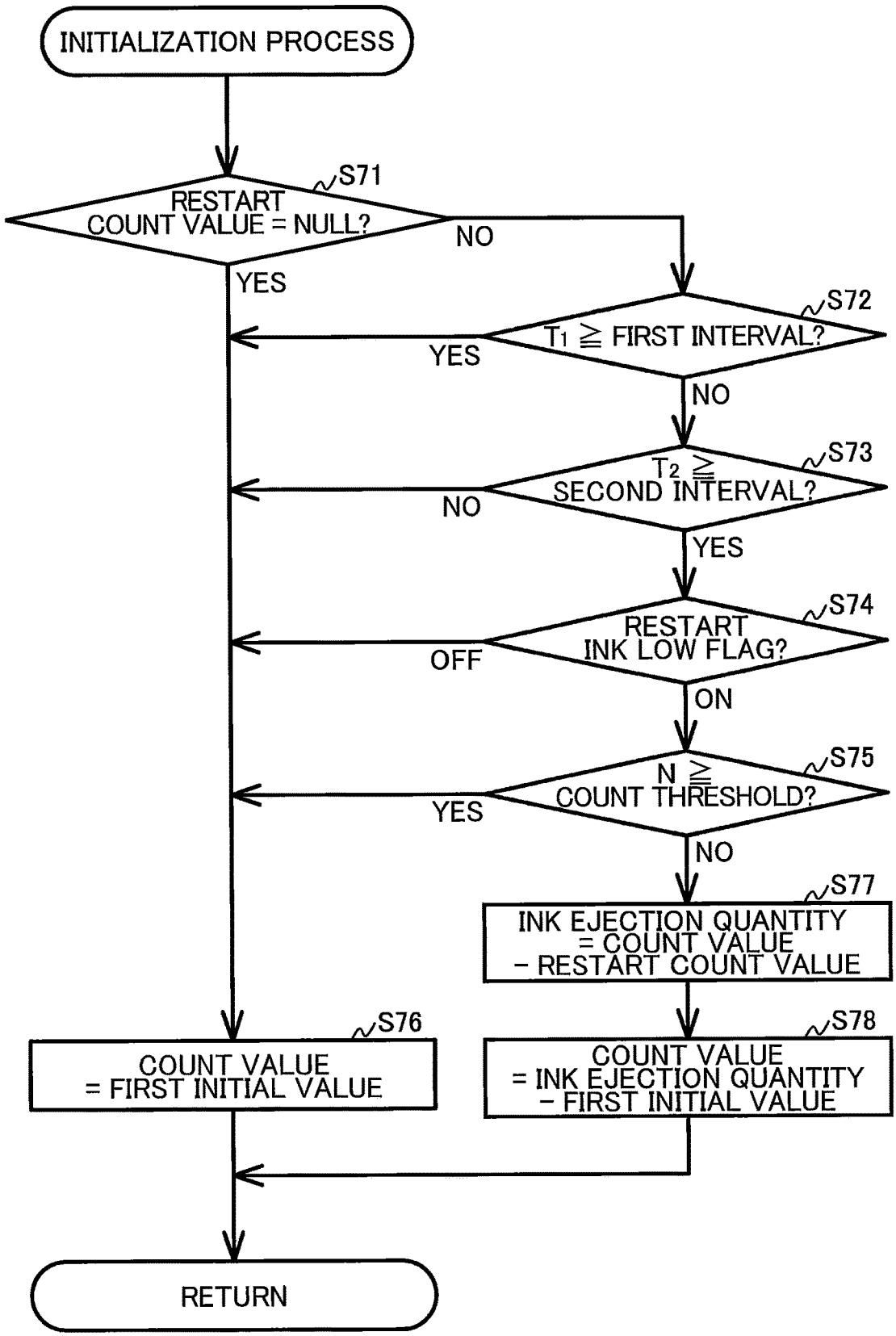
FIG. 9 is a flowchart illustrating steps in an initialization process executed by the controller 130.

In S71 of FIG. 9, the controller 130 determines whether the restart count value M is set to null. In S72 the controller 130 determines whether the cover-open time $T_1$ calculated in S53 is greater than or equal to the first interval. In S73 the controller 130 determines whether the switch OFF interval $T_2$ calculated in S33 is greater than or equal to a second interval. In S74 the controller 130 determines whether the restart ink low flag M is set to "ON" or "OFF". In S75 the controller 130 determines whether the switch-on count N updated in S36 or S37 is greater than or equal to a count threshold.

The first interval and the second interval are predetermined time intervals thought necessary for a typical user to refill an ink chamber 111 with ink, for example. The first interval and the second interval may be the same length or different lengths. In addition, the first interval and the second interval may be fixed values or may be variable values that increase in length when the number of ink chambers 111 in the ink low state is larger, i.e., when the number of the ink low flags set to "ON" is greater. The count threshold is a predetermined count thought to enable inference of the timing at which an ink chamber 111 has been refilled.

The controller 130 infers that the ink chamber 111 was refilled with ink just prior to the first inquiry process in response to the determination that: the restart count value M is set to null (S71: YES), the cover-open time $T_1$ is greater than or equal to the first interval (S72: YES), the switch OFF interval $T_2$ is less than the second interval (S73: NO), the restart ink low flag M is set to "OFF" (S74: OFF), or the switch-on count N is greater than or equal to the count threshold (S75: YES).

In response to the inference that ink was supplied just prior to the first inquiry process, in S76 the controller 130 sets the count value M to its first initial value (0) and sets the soft-empty flag M and the ink low flag M to "OFF". The first initial value is a value that provides the maximum difference between the count value M and the first threshold value. That is, when the count value is set to the first initial value, a difference between the first threshold value and the corresponding count value becomes maximum. In S76 of the initialization process performed for the ink chamber 111B, the controller 130 also sets the hard-empty flag to "OFF". The process in S76 is an example of a first initialization process.

On the other hand, the controller 130 infers that the ink chamber 111 was refilled while the power switching section 120 was in the switch OFF state in response to the determination that: the restart count value M is set to a value other than null (S71: NO), the cover-open time $T_1$ is less than the first interval (S72: NO), the switch OFF interval $T_2$ is greater than or equal to the second interval (S73: YES), the restart ink low flag M is set to "ON" (S74: ON), and the switch-on count N is less than the count threshold (S75: NO).

In response to the inference that the ink chamber 111 was refilled while the power switching section 120 was in the switch OFF state, in S77 the controller 130 calculates an ink ejection quantity. The ink ejection quantity is the quantity of ink that the recording section 24 ejected between the time that the ink chamber 111 was refilled while the power switching section 120 was in the switch OFF state and the present time. The controller 130 calculates the ink ejection quantity for magenta ink ejected from the recording section 24 based on a difference between the count value M and the restart count value M, for example.

In S78 the controller 130 sets the count value M to a second initial value, and sets the soft-empty flag M and the ink low flag M to "OFF". The second initial value is closer to the first threshold value than the first initial value is to the first threshold value by the ink ejection quantity calculated in S77. For example, the second initial value is obtained by subtracting the first initial value from the ink ejection quantity calculated in S77. The second initial value is equivalent to the ink ejection quantity calculated in S77 when the first initial value is 0 and the count value is incremented in S16. In S78 of the initialization process performed for the ink chamber 111B, the controller 130 also sets the hard-empty flag to "OFF". The process in S78 is an example of a second initialization process.

<Residual Ink Confirmation Process>

Figure 10:
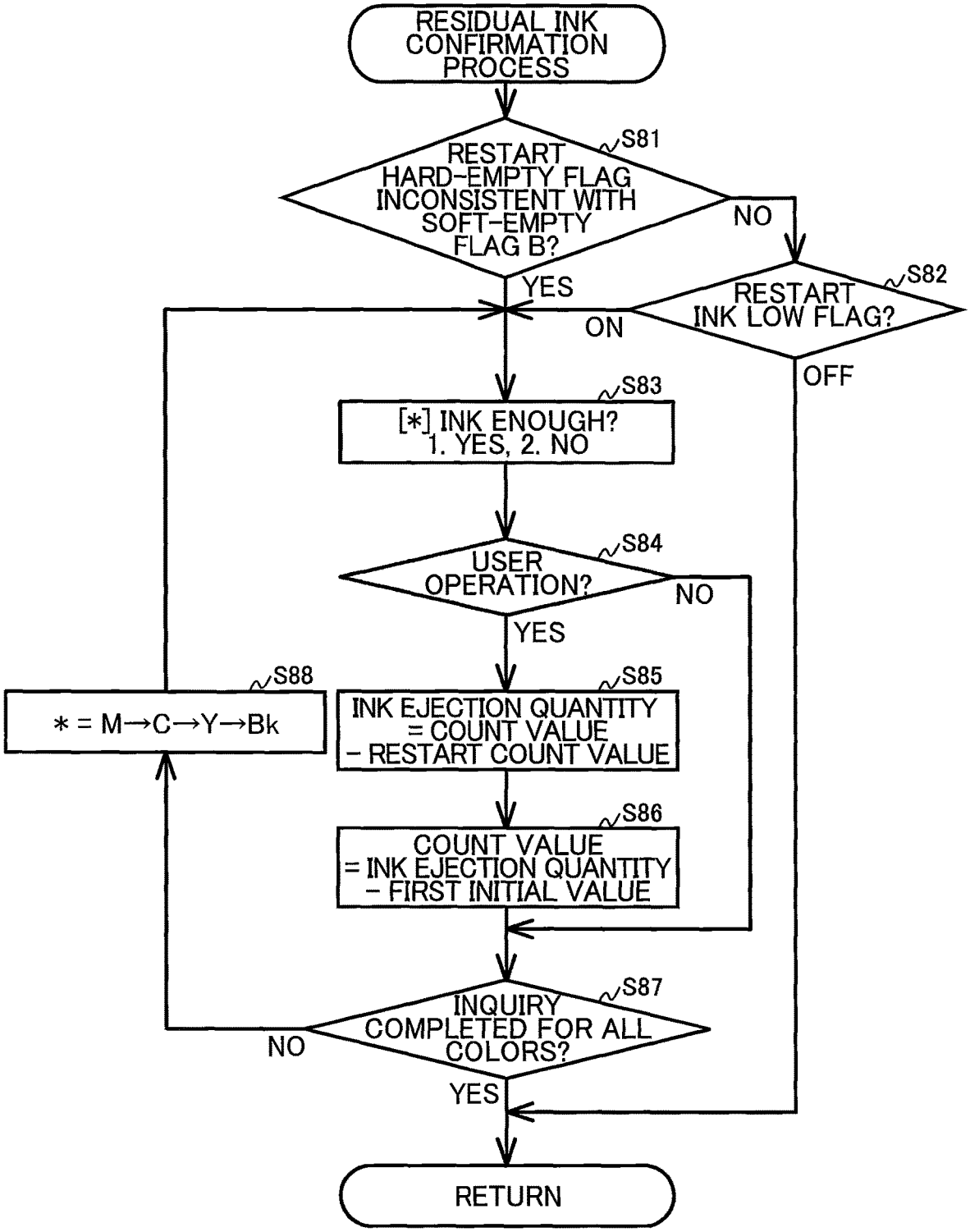
FIG. 10 is a flowchart illustrating steps in a residual ink confirmation process executed by the controller 130.

Next, the residual ink confirmation process will be described with reference to FIG. 10. The residual ink confirmation process is performed to prompt the user to check quantities of ink in the ink chambers 111 when the user indicates that ink chambers 111 were not refilled (i.e., when the [2] button is pressed while the preliminary inquiry screen is displayed). In S81 and S82 at the beginning of the process in FIG. 10, the controller 130 infers whether an ink chamber 111 was refilled while the power switching section 120 was in the switch OFF state. The process in S81 and S82 is an example of a six determination process. Here, the controller 130 need not execute both the process in S81 and S82, but should execute at least one of the process in S81 and S82.

In S81 the controller 130 determines whether the settings for the restart hard-empty flag and the soft-empty flag B do not match. More specifically, the controller 130 determines whether the restart hard-empty flag is set to "OFF" and the soft-empty flag B is set to "ON". In other words, in S81 the controller 130 determines whether the quantity of ink in the ink chamber 111B was at the detection position or higher when the power switching section 120 was last switched to the switch ON state and whether the ink chamber 111B is in the soft-empty state. In S82 the controller 130 also determines the settings of the restart ink low flags B, Y, C, and M.

The controller 130 infers that ink was supplied while the power switching section 120 was in the switch OFF state and executes the process from S83 in response to the determination that: the restart hard-empty flag is set to "OFF" and the soft-empty flag B is set to "ON" (S81: YES), or any one of the restart ink low flags B, Y, C, and M is set to "ON" (S82: ON). Accordingly, the process in S83-S87 is executed in the event that a user other than the user who pressed the [2] button while the preliminary inquiry screen was displayed supplied ink while the power switching section 120 was in the switch OFF state, or in the event that the user who pressed the [2] button while the preliminary inquiry screen was displayed has forgotten supplying ink while the power switching section 120 was in the switch OFF state.

In response to the determination that ink was injected into the ink chamber 111 while the power switching section 120 was in a switch OFF state, in S83 the controller 130 controls the display section 15 to display a second inquiry screen on the display section 15 targeting the ink chamber 111M. The second inquiry screen prompts the user to indicate whether the quantity of ink stored in the ink chamber 111M is sufficient. For example, a character string "M INK ENOUGH?" and a character string "1. YES, 2. NO" are alternately displayed in the second inquiry screen. The controller 130 controls the display section 15 to continuously display the second inquiry screen on the display section 15 until a third operation or a fourth operation is received through the operation section 17 (S84). The process in S83 and S84 is an example of a second inquiry process.

The third operation is a user operation for indicating that the ink chamber 111M stores a sufficient amount of ink, and corresponds to pressing the [1] button, for example. The fourth operation is a user operation for indicating that the ink chamber 111M does not hold a sufficient amount of ink, and corresponds to pressing the [2] button, for example. Note that the first operation and the third operation may correspond to pressing the same button or may correspond to pressing different buttons. This is also true for the second operation and the fourth operation. Further, the term "sufficient amount" denotes, for example, that approximately 50% of maximum storage quantity of the ink chamber 111M is filled with ink, or that ink is filled up to a third line (not illustrated) provided between the first line 146 and the second line 147.

Upon seeing the second inquiry screen, the user may visually inspect the amount of ink stored in the ink chamber 111M through the transparent window 71 of the cover 70, for example. Alternatively, the user may move the cover 70 to the exposing position and visually inspect the amount of ink stored in the ink chamber 111M upon seeing the second inquiry screen. Here, the controller 130 need not execute the cover open process if the cover open event is detected through the cover sensor 72 while the second inquiry screen is displayed.

In response to the pressing of the [1] button while the second inquiry screen targeting the ink chamber 111M is displayed (S84: YES), in S85 and S86 the controller 130 sets the count value M to the second initial value and sets the soft-empty flag M and ink low flag M to "OFF". The process in S86 is another example of the second initialization process as similar to the process in S78. On the other hand, in response to the pressing of the [2] button while the second inquiry screen targeting the ink chamber 111M is displayed (S84: NO), then the controller 130 jumps to step S87 without executing the process in S85 and S86.

In S87 the controller 130 determines whether the second inquiry process has been completed for all colors. In response to the determination that the second inquiry process has not been performed for all colors (S87: NO), in S88 the controller 130 sets the target color to the next color in the sequence M→C→Y→Bk. In this way, the process in S83-S86 is repeated for each of the ink chambers 111M, 111C, 111Y, and 111B. While repeating the process in S83-S86, the controller 130 executes the second initialization process on the target ink chamber 111 in response to the pressing of the [1] button, but does not execute the second initialization process in response to the pressing of the [2] button.

Further, when performing the process in S83-S86 targeting the ink chamber 111B, the controller 130 may also determine whether the ink chamber 111B is currently in the hard-empty state in response to the pressing of the [1] button while the second inquiry screen is displayed on the display section 15 (S84: YES). In response to the determination that the ink chamber 111B is not currently in the hard-empty state, the controller 130 then executes the process in S85 and S86. On the other hand, in response to the determination that the ink chamber 111B is currently in the hard-empty state, the controller 130 jumps to S87 without executing the process in S85 and S86.

In response to the determination that the restart hard-empty flag and the soft-empty flag B are set to the values other than the values when the restart hard-empty flag is set to "OFF" and the soft-empty flag B is set to "ON" (S81: NO) and that all of the restart ink low flags B, Y, C, and M are set to "OFF" (S82: OFF), the controller 130 infers that ink was not supplied while the power switching section 120 was in the switch OFF state. In this case, the controller 130 ends the residual ink confirmation process without executing the process in S83-S88 even one time.

Operational and Technical Advantages of the Embodiment

In the embodiment described above, the controller 130 infers whether the ink chamber 111 has been refilled while the power switching section 120 was in the switch OFF state and, in response to the inference that the ink chamber 111 has been refilled, initializes the count value for the ink chamber 111 while considering the quantity of ink ejected between the time the power switching section 120 changed to the switch ON state and the time the first inquiry process was executed. Through this process, the MFP 10 can suppress deviation between the residual ink quantity indicated by the count value and the actual quantity of ink stored in the ink chamber 111 even when the ink chamber 111 has been refilled while the power switching section 120 was in the switch OFF state.

Note that while the embodiment describes an example in which the first inquiry process is triggered by the detection of the cover close event (S52: YES→S56 and S57), a timing for executing the first inquiry process is not limited to this example. As another example, the controller 130 may execute the first inquiry process in response to receipt of a user operation through the operation section 17 instructing that a screen be displayed for resetting the count value.

When the restart count value is set to the null value, it may be assumed that the power switching section 120 was not switched to the switch OFF state after the process in S61 is performed. Further, a certain amount of time is required to perform the operation for refilling the ink chamber 111. Hence, the cover-open time $T_1$ must be at least the first interval in order for ink to be supplied just prior to the first inquiry process. Similarly, the switch OFF interval $T_2$ must be at least the second interval in order for ink to be supplied while the power switching section 120 is in the switch OFF state. Further, the user is more likely to refill an ink chamber 111 with ink during the switch OFF state when the amount of ink accommodated in the ink chamber 111 is lower. Thus, the accuracy of inference when the ink chamber 111 is refilled is improved by inferring the timing in processes of S71-S75.

Further, the second operation may be received irrespective of whether ink was supplied during the switch OFF state when the user performing the user operations in the preliminary inquiry process differs from the user who supplied ink while the power switching section 120 was in the switch OFF state. Accordingly, the MFP 10 prompts the user who performed the second operation to confirm the quantity of ink stored in the ink chamber 111 (S83) and executes the second initialization process when the ink chamber 111 stores sufficient ink (S84: YES→S85 and S86). This method can suppress deviation between the residual ink quantity specified by the count value and the actual quantity of ink stored in the ink chamber 111.

However, if the second inquiry screen is displayed on the display section 15 each time the second operation is performed for the preliminary inquiry screen, this will cause increase of the user's burden in performing operations. Therefore, by displaying the second inquiry screen only when there is a possibility that ink chamber 111 has been refilled during the switch OFF state (S81: YES or S82: ON), the MFP 10 can both improve the accuracy of the count value and simplify user operations.

The embodiment describes an example in which the residual ink confirmation process is executed when the second operation is performed for the preliminary inquiry screen. However, the event that causes execution of the residual ink confirmation process is not limited to this example. For example, the controller 130 may execute the residual ink confirmation process for the ink chamber 111M when the second operation is received while the first inquiry screen is displayed for the ink chamber 111M (S57: NO). The same process may be performed for ink chambers 111C, 111Y, and 111B.

In the switch ON process, the controller 130 in S31 confirms the settings for the restart count values to determine whether to execute the process in S32-S36 or the process in S37, but the method in S31 for determining whether to execute the process in S32-S36 or the process in S37 is not limited to this. For example, the controller 130 may infer whether the ink chamber 111 has been refilled with ink during the preceding switch OFF state, and execute the process in S32-S36 in response to the inference that the ink chamber 111 has been refilled during the preceding switch OFF state. On the other hand, the controller 130 may execute the process in S37 in response to inference that the ink chamber 111 has not been refilled during the preceding switch OFF state. Note that the process of S31 in FIG. 7A and the process according to the following variation may be combined as desired.

Figure 12:
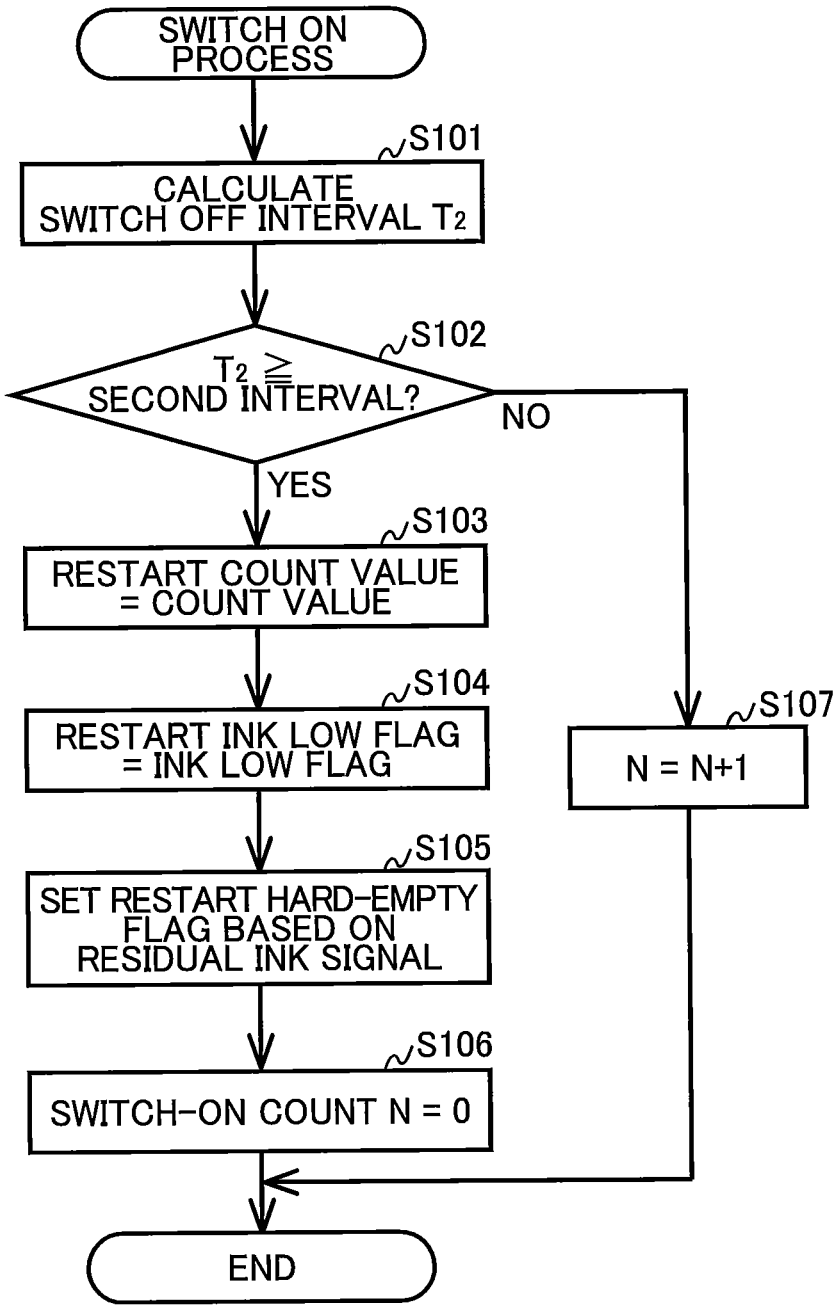
FIG. 12 is a flowchart illustrating steps in a switch ON process executed by the controller 130 according to another variation of the embodiment.

First, as illustrated in S101 of FIG. 12, the controller 130 calculates the switch OFF interval $T_2$ in response to the power switching section 120 being switched to the switch ON state. Then, as another example for S31 in the switch ON process, in S102 the controller 130 determines whether this switch OFF interval $T_2$ is greater than or equal to the second interval. The process in S102 is an example of a third determination process. The controller 130 may execute the process from S103 to S106 in response to the determination that the switch OFF interval $T_2$ is greater than or equal to the second interval, and may execute the process in S107 in response to the determination that the switch OFF interval $T_2$ is less than the second interval. Note that the processes in S103 to S106 correspond to the processes in S32, S34 to S36 in the embodiment, respectively, and the process in S107 corresponds to the process in S37 in the embodiment. The process in S103 is another example of the storing process.

An operation to refill the ink chamber 111 takes a certain amount of time. Accordingly, as in the variation described above, the controller 130 may infer that the ink chamber 111 has been refilled during the preceding switch OFF state and may update the restart count values when the switch OFF interval $T_2$ is greater than or equal to the second interval (S102: YES). In this way, the controller 130 can initialize the count value in S78 and S86 based on a suitable ink ejection quantity. In this case, the process in S73 is omitted.

Figure 13:
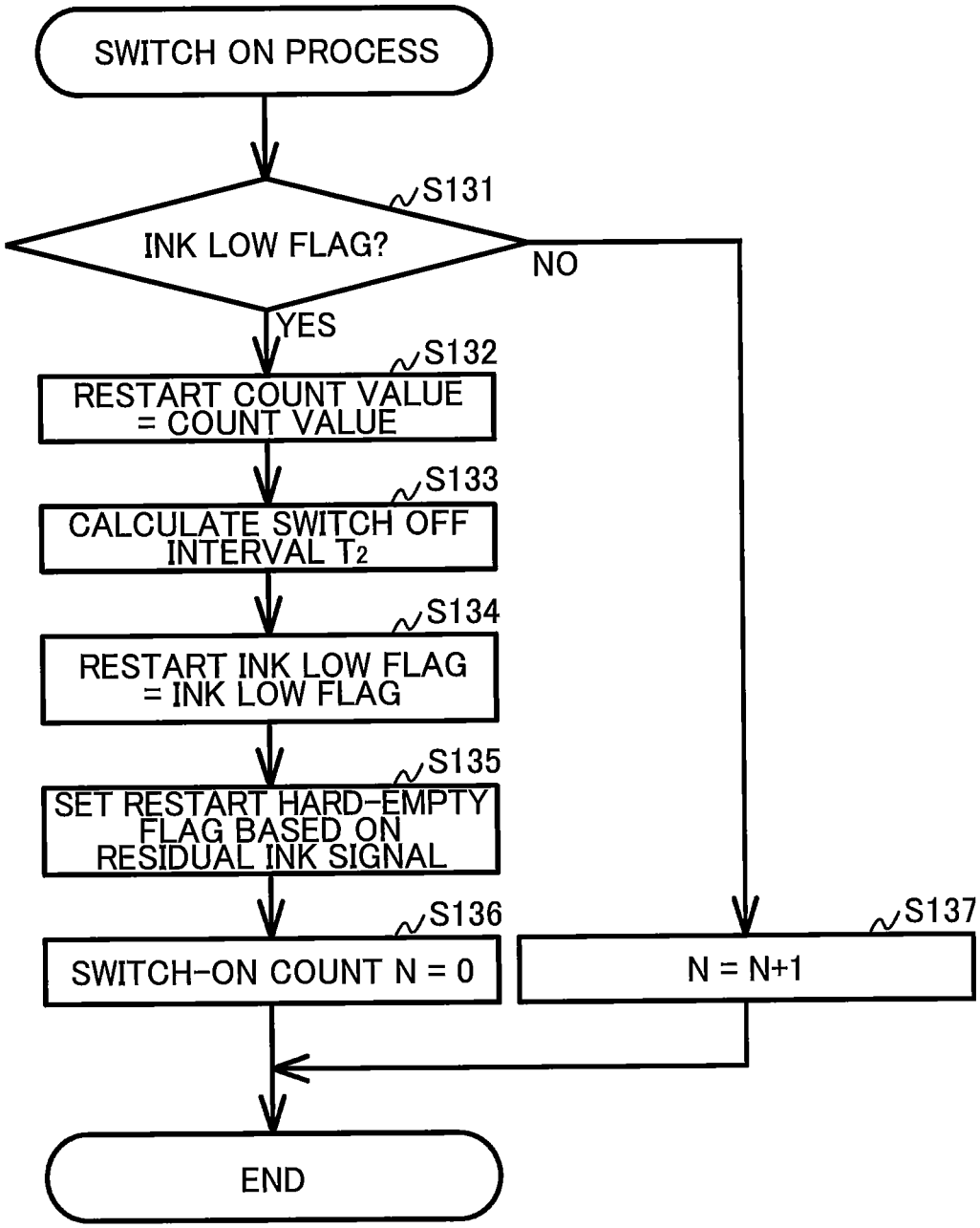
FIG. 13 is a flowchart illustrating steps in a switch ON process executed by the controller 130 according to still another variation of the embodiment.

As another example of S31, as illustrated in S131 in FIG. 13, the controller 130 determines whether any of the ink low flags B, Y, C, and M is set to "ON" in response to switch of the power switching section 120 to the switch ON state. Here, the controller 130 may execute the process from S132 in response to the determination that any one of the ink low flags B, Y, C, and M is set to "ON" (S131: YES), and may execute the process in S137 in response to the determination that all of the ink low flags B, Y, C, and M are set to "OFF" (S131: NO). Note that the processes from S132 to S136 correspond to the processes from S32 to S36 in the embodiment, respectively, and the process in S137 corresponds to the process in S37 in the embodiment. The process in S131 is an example of a fourth determination process and the process in S132 is another example of the storing process.

The probability that a user will supply ink during the switch OFF state is higher when the quantity of ink stored in the ink chamber 111 is lower. Further, if any of the ink low flags B, Y, C, and M is set to "ON", a user attempting to pull the plug of the MFP 10 will see the ink low notification screen displayed on the display section 15. Accordingly, the probability that the user will refill the ink chamber 111 with ink after unplugging the MFP 10 is higher. Hence, as in the variation described above, the controller 130 may infer that the ink chamber 111 has been refilled during the preceding switch OFF state if one of the ink low flags B, Y, C, and M was set to "ON" (S131: YES) and may update the restart count value for the corresponding ink chamber 111. With this method, the controller 130 can initialize the count value for the ink chamber 111 in S78 and S86 based on a suitable ink ejection quantity.

Figure 14:
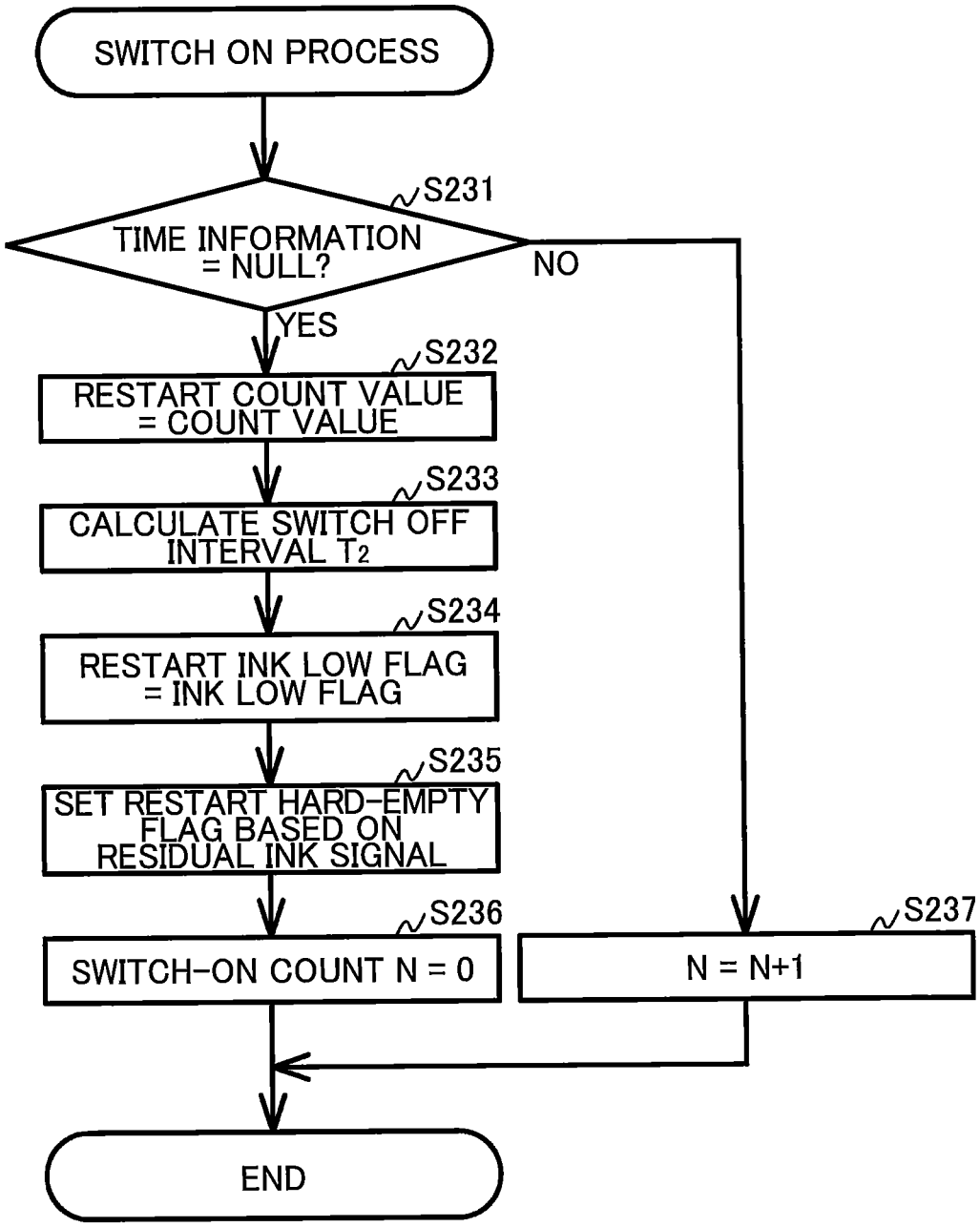
FIG. 14 is a flowchart illustrating steps in a switch ON process executed by the controller 130 according to still another variation of the embodiment.

As still another example of S31, as illustrated in S231 of FIG. 14, the controller 130 determines whether the time information outputted from the internal clock 135 is set to the initial value in response to the switch of the power switching section 120 to the switch ON state. The controller 130 may then execute the process from S232 in response to the determination that the time information is the initial value (S231: YES). Here, it is preferable that the controller 130 executes the process from S232 when the time information is the initial value, without executing any of the other determination processes described above. On the other hand, the controller 130 may execute the process in S237 in response to the determination that the time information is not the initial value (S231: NO). Note that the processes from S232 to S236 correspond to the processes from S32 to S36 in the embodiment, respectively, and the process in S237 corresponds to the process in S37 in the embodiment. The process in S231 is an example of a fifth determination process, and the process in S232 is another example of the storing process.

The time information outputted from the internal clock 135 may be reset to the initial value when the charge in the internal power supply 121 becomes depleted, for example. In other words, since the power switching section 120 was in the plug OFF state for a long period, there is a high probability that ink was supplied during this time. Thus, as in the variation described above, it is preferable to initialize the count value in S78 and S86 based on the quantity of ink ejected between that point and the first inquiry process.

The present embodiment describes an example in which the trigger for executing the process in FIG. 7A is the power switching section 120 switching from the plug OFF state and the switch OFF state to the switch ON state. However, the trigger for executing the process of FIG. 7A may be the power switching section 120 changing from the plug ON state and the switch OFF state to the switch ON state. In other words, the controller 130 may execute the process of FIG. 7A if the power button 17B is pressed while the power switching section 120 is in the switch ON state and is subsequently pressed again.

That is, the switch ON state is an example of a first state, and the plug OFF state and switch OFF state are examples of a second state. However, the first and second states are not limited to these examples. That is, the first state is a state in which electric power is supplied to at least the recording section 24 and the display section 15, but there is no limitation on supplying power to other components. On the other hand, the second state is a state in which electric power is not supplied to at least the recording section 24 and the display section 15, but there is no limitation on supplying power to other components.

Further, the above-described embodiment describes an example in which power is not supplied to the cover sensor 72 and the residual ink sensor 73 when the power switching section 120 is in the switch OFF state. However, the power switching section 120 may supply power to the controller 130 and the cover sensor 72 in the switch OFF state. In other words, the controller 130 may be capable of detecting the cover open event and the cover close event through the cover sensor 72 while the power switching section 120 is in the switch OFF state.

Figure 11A:
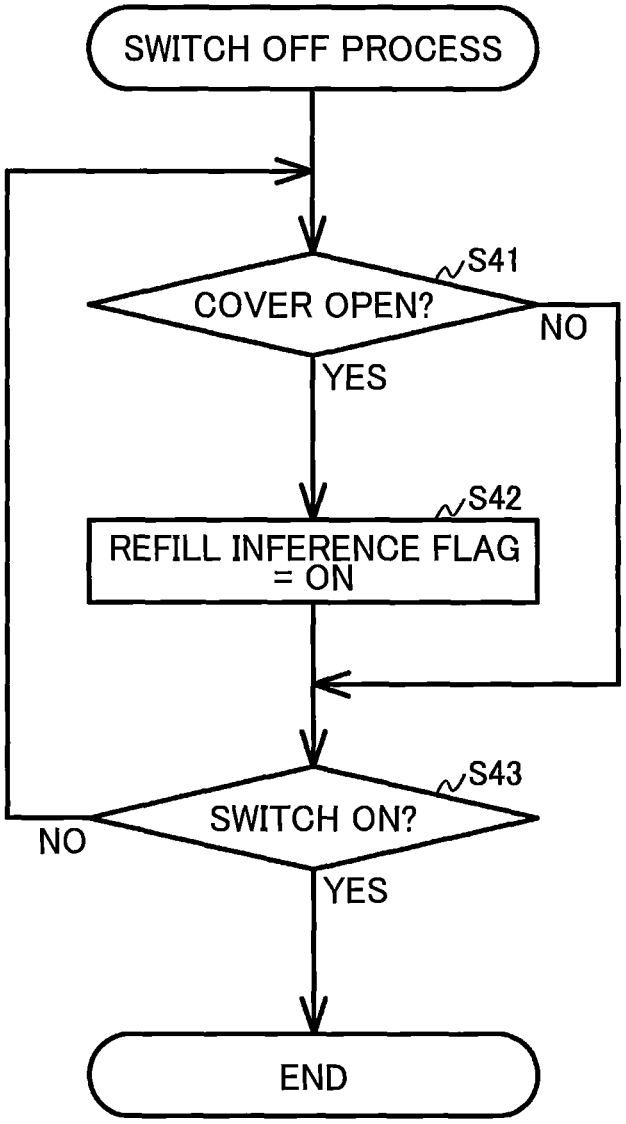
FIG. 11A is a flowchart illustrating steps in a switch OFF process executed by the controller 130.

In the above variation, the EEPROM 134 may also store a refill inference flag. The refill inference flag indicates the results of inferring whether the ink chamber 111 has been refilled with ink. The refill inference flag is either set to "ON" (a first value) that corresponds to inference that the ink chamber 111 has been refilled, or "OFF" (a second value)

that corresponds to inference that the ink chamber 111 has not been refilled. The initial value of the refill inference flag is "OFF". The controller 130 may execute a switch OFF process illustrated in FIG. 11A in response to the switch of the power switching section 120 from the switch ON state to the switch OFF state.

In S41 of the switch OFF process, the controller 130 determines whether the cover open event was detected through the cover sensor 72. If the cover open event was not detected (S41: NO), in S43 the controller 130 determines whether the power switching section 120 changed from the switch OFF state to the switch ON state. If the power switching section 120 has not changed to the switch ON state (S43: NO), the controller 130 returns to S41 and continues waiting until either the cover open event has occurred or the power switching section 120 has switched to the switch ON state. In response to the detection of the cover open event while the power switching section 120 remains in the switch OFF state (S41: YES), in S42 the controller 130 sets the refill inference flag to "ON". The process in S42 is an example of a first setting process. Further, in response to the determination that the power switching section 120 has changed from the switch OFF state to the switch ON state (S43: YES), the controller 130 ends the switch OFF process.

Figure 11B:
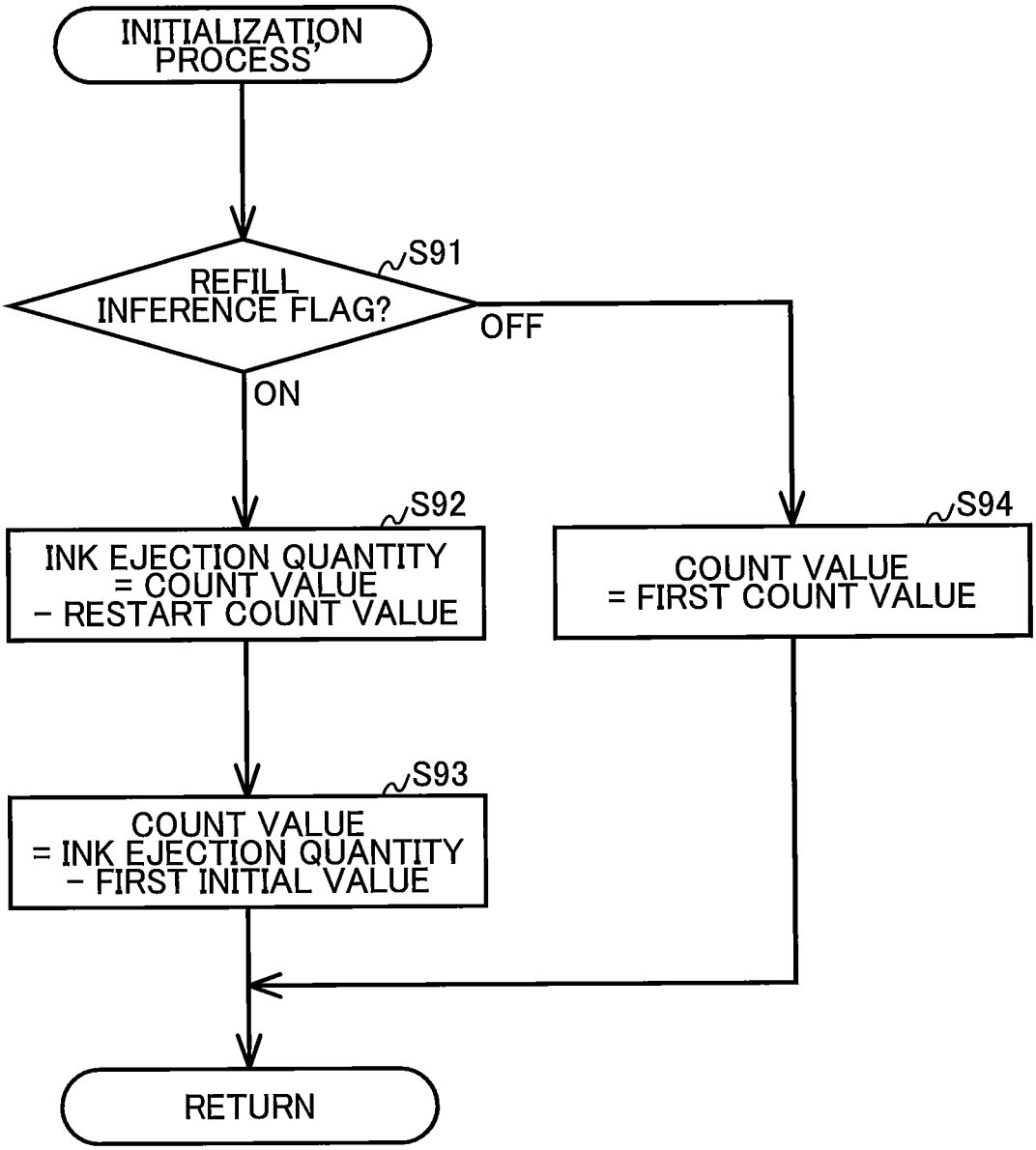
FIG. 11B is a flowchart illustrating steps in an initialization process' executed by the controller 130 according to a variation of the embodiment.

In S91 of an initialization process' illustrated in FIG. 11B, the controller 130 next determines the setting of the refill inference flag in place of steps S71-S75 in the initialization process. More specifically, in S91 the controller 130 determines whether the refill inference flag is set to either "ON" or "OFF". This process in S91 is another example of the first determination process. In response to the determination that the refill inference flag is set to "OFF" (S91: OFF), the controller 130 infers that ink has been supplied just prior to the first inquiry process and executes the process in S94. On the other hand, in response to the determination that the refill inference flag is set to "ON" (S91: ON), the controller 130 infers that ink has been supplied while the power switching section 120 was in the switch OFF state, and executes the process in S92 and S93. Note that the processes in S92 and S93 are identical to the processes in S77 and S78 in the embodiment, respectively, and the process in S94 is identical to the process in S76 in the embodiment. In addition, the controller 130 also sets the refill inference flag to "OFF" in S61 of the cover open process. This process in S61 is an example of a second setting process.

With the MFP 10 having such the structure, the user cannot refill the ink chamber 111 with ink without moving the cover 70 to the exposing position. Hence, when the refill inference flag is set to "OFF", it may be assumed that ink has not been supplied while the power switching section 120 was in the switch OFF state. Therefore, the MFP 10 in this variation can infer the timing at which ink chamber 111 has been refilled based on the setting of the refill inference flag, thereby improving the precision of inference.

Further, the above-described embodiment describes an example of the power switching section 120 supplying electric power acquired from an external power source to components of the MFP 10. However, the power switching section 120 may be configured to supply electric power in the first state from the charged internal power supply 121, rather than electric power acquired from the external power source, to power the components of the MFP 10. In this case, the internal power supply 121 is preferably configured of a large-capacity battery rather than a small-capacity battery that only has the capacity for storing power needed to update the internal clock 135 or to power the cover sensor 72.

The above-mentioned embodiment describes an example in which the ink detection portion 152 and the residual ink sensor 73 are only provided for the tank 100B. However, the ink detection portion 152 and the residual ink sensor 73 may be provided for each of the tanks 100B, 100Y, 100C, and 100M or for none of the tanks 100B, 100Y, 100C, and 100M. For example, when the ink detection portion 152 and the residual ink sensor 73 are provided for each of the tanks 100B, 100Y, 100C, and 100M, in S11, and S18 the controller 130 may employ hard-empty flags Y, C, and M in place of the soft-empty flags Y, C, and M. However, when the ink detection portion 152 and the residual ink sensor 73 are not provided for any of the tanks 100B, 100Y, 100C, and 100M, in S11, and S18 the controller 130 may employ a soft-empty flag B in place of the hard-empty flag.

As another variation, rather than determining the settings of the flags in S11, S18, S74, and S82, the controller 130 may determine whether the ink chambers 111 are in the hard-empty state, the soft-empty state, or the ink low state. Specifically, in S11, and S18 the controller 130 may determine whether the difference between the count value and either the first threshold value or the second threshold value is greater than or equal to 0 for each of the ink chambers 111B, 111Y, 111C, and 111M. Further, in S74, and S82 the controller 130 may determine whether the difference between the restart count value and the second threshold value is greater than or equal to 0 for each of the ink chambers 111B, 111Y, 111C, and 111M. The controller 130 may determine in S11 whether the residual ink signal outputted from the residual ink sensor 73 is the first residual ink signal (S11: OFF) or the second residual ink signal (S11: ON).

While the description has been made in detail with reference to the embodiment(s) thereof, it would be apparent to those skilled in the art that many modifications and variations may be made therein without departing from the scope of the disclosure.

What is claimed is:

1. An inkjet recording apparatus comprising:

a tank having an ink chamber configured to store ink therein and formed with an inlet through which the ink is supplied into the ink chamber;

a recording head configured to eject the ink stored in the ink chamber toward a sheet to record an image thereon;

a memory storing a first threshold value and a count value, the count value being indicative of an accumulated count value and being updated toward the first threshold value in accordance with ejection of ink;

a display;

an operation interface configured to receive a user operation including a first operation and a second operation;

a power switching section configured to be switched between a first state and a second state, wherein under the first state, the power switching section supplies an electric power to both the recording head and the display, whereas under the second state, the power switching section interrupts supply of an electric power to both the recording head and the display; and a controller configured to:

execute a first inquiry process to:

control the display to display a first inquiry screen inquiring whether the ink chamber has been refilled with ink; and receive either one of the first operation and the second operation through the operation interface, wherein the first operation indicates that the ink chamber has been refilled with ink, whereas the second operation indicates that the ink chamber has not been refilled with ink;

after receiving the first operation in the first inquiry process, execute a first determination process to determine when the ink chamber has been refilled with ink;

in response to determining in the first determination process that the ink chamber has been refilled with ink at a time just before the first inquiry process, execute a first initialization process to set the count value to a first initial value, a difference between the count value and the first threshold value becoming maximum when the count value is set to the first initial value; and in response to determining in the first determination process that the ink chamber has been refilled with ink while the power switching section is in the second state, execute a second initialization process to set the count value to a second initial value, the second initial value being closer to the first threshold value than the first initial value is to the first threshold value by an ink ejection quantity, the ink ejection quantity being a quantity of ink ejected from the recording head since the power switching section was switched from the second state to the first state.

2. The inkjet recording apparatus according to claim 1, further comprising:

a cover movable between a covering position covering the inlet to restrict supply of ink into the ink chamber and an exposing position exposing the inlet to an outside to allow supply of ink into the ink chamber; and a cover sensor configured to detect whether the cover is in the covering position or the exposing position, wherein the controller is further configured to:

calculate an cover-open time, the cover-open time being a time interval during which the cover is in the exposing position;

in response to detecting through the cover sensor that the cover was moved to the covering position, execute the first inquiry process;

determine whether the cover-open time is greater than or equal to a first interval;

in response to determining that the cover-open time is greater than or equal to the first interval, determine in the first determination process that the ink chamber has been refilled with ink at a time just before the first inquiry process; and after determining that the cover-open time is less than the first interval, determine in the first determination process that the ink chamber has been refilled with ink while the power switching section is in the second state.

3. The inkjet recording apparatus according to claim 1, wherein the memory further stores a switching-point count value, and wherein the controller is further configured to:

execute a storing process to set the switching-point count value to a valid value, the valid value being indicative of the count value indicated at a time when the power switching section is switched from the second state to the first state;

calculate a difference between the switching-point count value and the count value as the ink ejection quantity;

execute the second initialization process using the calculated ink ejection quantity;

after executing one of the first initialization process and the second initialization process, execute a third initialization process to set the switching-point count value to an invalid value;

determine whether the switching-point count value is set to the invalid value or the valid value;

in response to determining that the switching-point count value is set to the invalid value, determine in the first determination process that the ink chamber has been refilled with ink at a time just before the first inquiry process; and after determining that the switching-point count value is set to the valid value, determine in the first determination process that the ink chamber has been refilled with ink while the power switching section is in the second state.

4. The inkjet recording apparatus according to claim 3, wherein the controller is further configured to:

calculate a non-powered time duration, the non-powered time duration being a time interval during which the power switching section is in the second state at a time just before the storing process;

determine whether the non-powered time duration is greater than or equal to a second interval;

in response to determining that the non-powered time duration is less than the second interval, determine in the first determination process that the ink chamber has been refilled with ink at a time just before the first inquiry process; and after determining that the non-powered time duration is greater than or equal to the second interval, determine in the first determination process that the ink chamber has been refilled with ink while the power switching section is in the second state.

5. The inkjet recording apparatus according to claim 3, wherein the memory further stores a second threshold value, a difference between the second threshold value and the count value reaching zero (0) before the difference between the first threshold value and the count value reaches zero (0), and wherein the controller is further configured to:

determine whether a difference between the second threshold value and the first initial value is greater than or equal to a difference between the switching-point count value and the first initial value;

in response to determining that the difference between the second threshold value and the first initial value is greater than or equal to the difference between the switching-point count value and the first initial value, determine in the first determination process that the ink chamber has been refilled with ink at a time just before the first inquiry process; and after determining that the difference between the second threshold value and the first initial value is less than the difference between the switching-point count value and the first initial value, determine in the first determination process that the ink chamber has been refilled with ink while the power switching section is in the second state.

6. The inkjet recording apparatus according to claim 3, wherein the memory further stores a switching count, the switching count being indicative of number of times that the power switching section was switched from the second state to the first state, and wherein the controller is further configured to:

in response to the power switching section being switched from the second state to the first state, execute a second determination process to determine whether the switching-point count value is set to the valid value;

in response to determining in the second determination process that the switching-point count value is set to the invalid value, execute the storing process;

after executing the storing process, execute a fourth initialization process to set the switching count to an initial value;

in response to determining in the second determination process that the switching-point count value is set to the valid value, execute an incrementing process to increment the switching count;

determine whether the switching count is greater than or equal to a count threshold;

in response to determining that the switching count is greater than or equal to the count threshold, determine in the first determination process that the ink chamber has been refilled with ink at a time just before the first inquiry process; and after determining that the switching count is less than the count threshold, determine in the first determination process that the ink chamber has been refilled with ink while the power switching section is in the second state.

7. The inkjet recording apparatus according to claim 1, further comprising:

a cover movable between a covering position covering the inlet to restrict supply of ink into the ink chamber and an exposing position exposing the inlet to an outside to allow supply of ink into the ink chamber; and a cover sensor configured to detect whether the cover is in the covering position or the exposing position, wherein the second state includes a plug OFF state and a switch OFF state, wherein under the plug OFF state, the power switching section does not receive an electric power from an external power source, whereas under the switch OFF state, the power switching section is configured to supply an electric power to both the controller and the cover sensor, wherein the memory further stores a refill inference flag, and wherein the controller is further configured to:

in response to detecting through the cover sensor that the cover was moved to the exposing position while the power switching section is in the second state, execute a first setting process to set the refill inference flag to a first value;

after receiving the first operation in the first inquiry process, execute a second setting process to set the refill inference flag to a second value;

determine whether the refill inference flag is set to either one of the first value and the second value;

in response to determining that the refill inference flag is set to the second value, determine in the first determination process that the ink chamber has been refilled with ink at a time just before the first inquiry process; and in response to determining that the refill inference flag is set to the first value, determine in the first determination process that the ink chamber has been refilled with ink while the power switching section is in the second state.

8. The inkjet recording apparatus according to claim 1, wherein the memory further stores a switching-point count value, and wherein the controller is further configured to:

calculate a non-powered time duration, the non-powered time duration being a time interval during which the power switching section is in the second state;

in response to the power switching section being switched from the second state to the first state, execute a third determination process to determine whether the non-powered time duration is greater than or equal to a second interval;

in response to determining in the third determination process that the non-powered time duration is greater than or equal to the second interval, execute a storing process to set the switching-point count value to the count value at a time when the power switching section was switched from the second state to the first state;

calculate a difference between the switching-point count value and the count value as the ink ejection quantity; and execute the second initialization process using the calculated ink ejection quantity.

9. The inkjet recording apparatus according to claim 1, wherein the memory further stores a second threshold value, a difference between the second threshold value and the count value reaching zero (0) before the difference between the first threshold value and the count value reaches zero (0), and wherein the controller is further configured to:

in response to the power switching section being switched from the second state to the first state, execute a fourth determination process to determine whether a difference between the second threshold value and the first initial value is greater than or equal to a difference between the count value and the first initial value;

in response to determining in the fourth determination process that the difference between the second threshold value and the first initial value is less than the difference between the count value and the first initial value, execute a storing process to set the switching-point count value to the count value at a time when the power switching section was switched from the second state to the first state;

calculate a difference between the switching-point count value and the count value as the ink ejection quantity; and execute the second initialization process using the calculated ink ejection quantity.

10. The inkjet recording apparatus according to claim 1, further comprising an internal power supply capable of storing an electric power supplied from an external power source, wherein the memory further stores a switching-point count value, and wherein the controller includes an internal clock configured to output time information, the internal clock being operated by the electric power supplied from the external power source when the power switching section is in the first state, the internal clock being operated by an electric power supplied from the internal power supply when the power switching section is in the second state, the time information being set to an initial value in a state where the power switching section is in the second state and when the electric power stored in the internal power supply has been depleted, the controller being further configured to:

in response to the power switching section being switched from the second state to the first state, execute a fifth determination process to determine whether the time information is set to the initial value;

in response to determining in the fifth determination process that the time information is set to the initial value, execute a storing process to set the switching-point count value to the count value at a time when the power switching section was switched from the second state to the first state;

calculate a difference between the switching-point count value and the count value as the ink ejection quantity; and execute the second initialization process using the calculated ink ejection quantity.

11. The inkjet recording apparatus according to claim 1, wherein the tank has an outer wall, at least a portion of the outer wall allowing the ink stored in the ink chamber to be visible from an outside, and wherein the controller is further configured to:

after receiving the second operation in the first inquiry process, execute a second inquiry process to:

control the display to display a second inquiry screen inquiring whether a sufficient quantity of ink is stored in the ink chamber; and receive either one of a third operation and a fourth operation through the operation interface, wherein the third operation indicates that a sufficient quantity of ink is stored in the ink chamber, whereas the fourth operation indicates that a sufficient quantity of ink is not stored in the ink chamber; and in response to receiving the third operation in the second inquiry process, execute the second initialization process.

12. The inkjet recording apparatus according to claim 11, wherein the controller is further configured to:

in response to receiving the second operation in the first inquiry process, execute a sixth determination process to determine whether the ink chamber has been refilled with ink while the power switching section is in the second state; and in response to determining in the sixth determination process that ink chamber has been refilled with ink while the power switching section is in the second state, execute the second inquiry process.

13. The inkjet recording apparatus according to claim 12, further comprising a residual ink sensor configured to detect whether a level of the ink stored in the ink chamber is higher than or equal to a detection position, wherein the controller is further configured to:

determine in the sixth determination process that ink chamber has been refilled with ink while the power switching section is in the second state in response to determining that:

the level of the ink stored in the ink chamber at a time when the power switching section was switched from the second state to the first state is higher than or equal to the detection position; and a difference between the first threshold value and the first initial value is less than a difference between the count value and the first initial value.

14. The inkjet recording apparatus according to claim 12, wherein the memory further stores a second threshold value, a difference between the second threshold value and the count value reaching zero (0) before the difference between the first threshold value and the count value reaches zero (0), wherein the controller is further configured to:

determine in the sixth determination process that ink chamber has been refilled with ink in response to determining that a difference between the second threshold value and the first initial value is less than a difference between the count value at a time when the power switching section was switched from the second state and the first initial value.

* * * * *